US005333412A

United States Patent [19]

Matsuyama

[11] Patent Number: 5,333,412

[45] Date of Patent: Aug. 2, 1994

[54] APPARATUS FOR AND METHOD OF OBTAINING PROCESSING INFORMATION FOR FITTING LENSES IN EYEGLASSES FRAME AND EYEGLASSES GRINDING MACHINE

[75] Inventor: Yoshinori Matsuyama, Gamagori, Japan

[73] Assignee: Nidek Co., Ltd., Gamagori, Japan

[21] Appl. No.: 994,160

[22] Filed: Dec. 21, 1992

Related U.S. Application Data

[63] Continuation-in-part of Ser. No. 741,899, Aug. 8, 1991, abandoned.

[30] Foreign Application Priority Data

Aug. 9, 1990 [JP] Japan ..... 02-213416

[51] Int. Cl.[5] ..... B24B 49/00

[52] U.S. Cl. ..... 51/165.71; 51/101 LG; 51/284 R

[58] Field of Search ..... 51/165.71, 165.74, 101 LG, 51/105 LG, 284 R, 284 L, 106 LG

[56] References Cited

U.S. PATENT DOCUMENTS

| | | | |
|---|---|---|---|
| 3,786,600 | 1/1974 | Bloxsom | 51/101 LG |
| 4,051,601 | 10/1977 | Godot | 51/101 LG |
| 4,737,918 | 4/1988 | Langlois et al. | 51/165.71 |
| 4,945,684 | 8/1990 | Wada et al. | 51/165.71 |
| 5,121,550 | 6/1992 | Wood et al. | 51/105 LG |
| 5,155,940 | 10/1992 | Suzuki | 51/165.71 |

FOREIGN PATENT DOCUMENTS

| | | |
|---|---|---|
| 0238877 | 2/1987 | European Pat. Off. . |
| 3841493 | 6/1990 | European Pat. Off. . |
| 3933906 | 2/1991 | European Pat. Off. . |

*Primary Examiner*—M. Rachuba

*Attorney, Agent, or Firm*—Nikaido, Marmelstein, Murray & Oram

[57] ABSTRACT

An eyeglass grinding machine of the present invention measures three-dimensional information on the configuration of an eyeglass frame so as to process lenses on the basis of the information thus measured. The improvement of the invention provides an apparatus for and a method of obtaining processing information for fitting lenses in the eyeglass frame that incorporate a measurement device for the three-dimensional configuration of the eyeglasses frame, including a holder device of the eyeglasses frame, a gauge head and detection device; a first calculation device for calculating a distance between the geometrical centers of both lens frame portions of the eyeglasses frame; an input device for inputting information of a pupillary distance; a second calculation device for calculating an apparent adjustment amount of the optical centers of the lenses; a third calculation device including contact elements to abut against the front and rear surfaces of the lenses; a correction means for correcting errors of the apparent adjustment amount; and a conversion device for converting the results of detection by the detection device into a predetermined form of processing information.

9 Claims, 18 Drawing Sheets

APPARATUS FOR AND METHOD OF OBTAINING PROCESSING INFORMATION FOR FITTING LENSES IN EYEGLASSES FRAME AND EYEGLASSES GRINDING MACHINE

CROSS REFERENCE TO RELATED APPLICATION

This is a continuation in part of patent application Ser. No. 07/741899 filed on Aug. 8, 1991 now abandoned.

BACKGROUND OF THE INVENTION

1. Field of the Invention

The present invention relates to an apparatus for and a method of obtaining processing information for fitting lenses in an eyeglass frame and an eyeglass grinding machine.

2. Description of the Related Art

The adjustment of glasses is generally effected by making the distance between the optical centers of the lenses coincide with the pupillary distance (PD). For this purpose, the distance between the geometrical centers of the lens frame portions, (FPD), is usually obtained, and, from this FPD value and the PD value, the adjustment amount (the amount of displacement of the optical center of the lens from the geometrical center thereof) is calculated.

Conventionally, eyeglass lenses have been processed using the adjustment amount calculated on the assumption that both the frame and the lenses are plane surfaces.

In practice, however, various factors, such as the inclination of the eyeglass frame, the lens thickness and the lens curve, have to be taken into account, which means errors are inevitable in the above calculation. This is particularly true of a large-sized frame with a large amount of warp. Such errors may be corrected to some extent by a skilled operator. However, the intuition of the operator alone cannot help to obtain a satisfactory degree of precision.

This invention has been made in view of the problem mentioned above. It is an object of this invention to provide an apparatus for and a method of obtaining processing information for fitting lenses in an eyeglass frame and an eyeglass grinding machine, which allows the adjustment amount to be previously calculated so that the distance between the optical centers of the processes lenses may exactly coincide with the designated PD value, irrespective of the configuration of the frame and lenses.

SUMMARY OF THE INVENTION

In accordance with this invention, the above object is achieved by an apparatus for obtaining processing information for fitting lenses in an eyeglass frame, comprising: (a) a measurement device for measuring the three-dimensional configuration of the eyeglasses frame, the measurement device including a holder means for holding the eyeglasses frame, a gauge head to be closely fitted in a groove portion of the eyeglasses frame, and a detection means for detecting a radius vector direction of the gauge head and displacements thereof in the radius vector direction and the vertical direction; (b) a first calculation means for calculating a distance between the geometrical centers of left and right lens frame portions of the eyeglasses frame from the results of detection by the detection means; (c) an input means for inputting information in relation to an adjustment amount, which includes a pupillary distance measured by a device; (d) a second calculation means for calculating an apparent adjustment amount of the optical centers of the lenses to be processed from the distance between the geometrical centers obtained by the first calculation means and the information inputted by the input means; (e) a third calculation means including contact elements to abut against the front and rear surfaces of the lenses to be processed so as to obtain the lens curve from movement amounts of the contact elements at at least four points on the lenses to be processed; (f) a correction means for correcting errors of the apparent adjustment amount, which are caused by fitting conditions of the lenses to be processed, on the basis of the following data: (i) apparent V-groove apex positions established on the basis of the apparent adjustment amount obtained by the second calculation means; (ii) the lens curve obtained by the third calculation means; and (iii) the pupillary distance inputted by the input means; and (g) a conversion means for converting the results of detection by the detection means into a predetermined form of processing information on the basis of the corrected adjustment amount obtained by the correction means.

DETAILED DESCRIPTION OF THE PREFERRED EMBODIMENTS

An embodiment of the present invention will now be described in detail with reference to the accompanying drawings. Descriptions of those component parts which are not directly related to this invention will be omitted.

(1) General Construction of an Eyeglasses Grinding Machine

Figure 1:
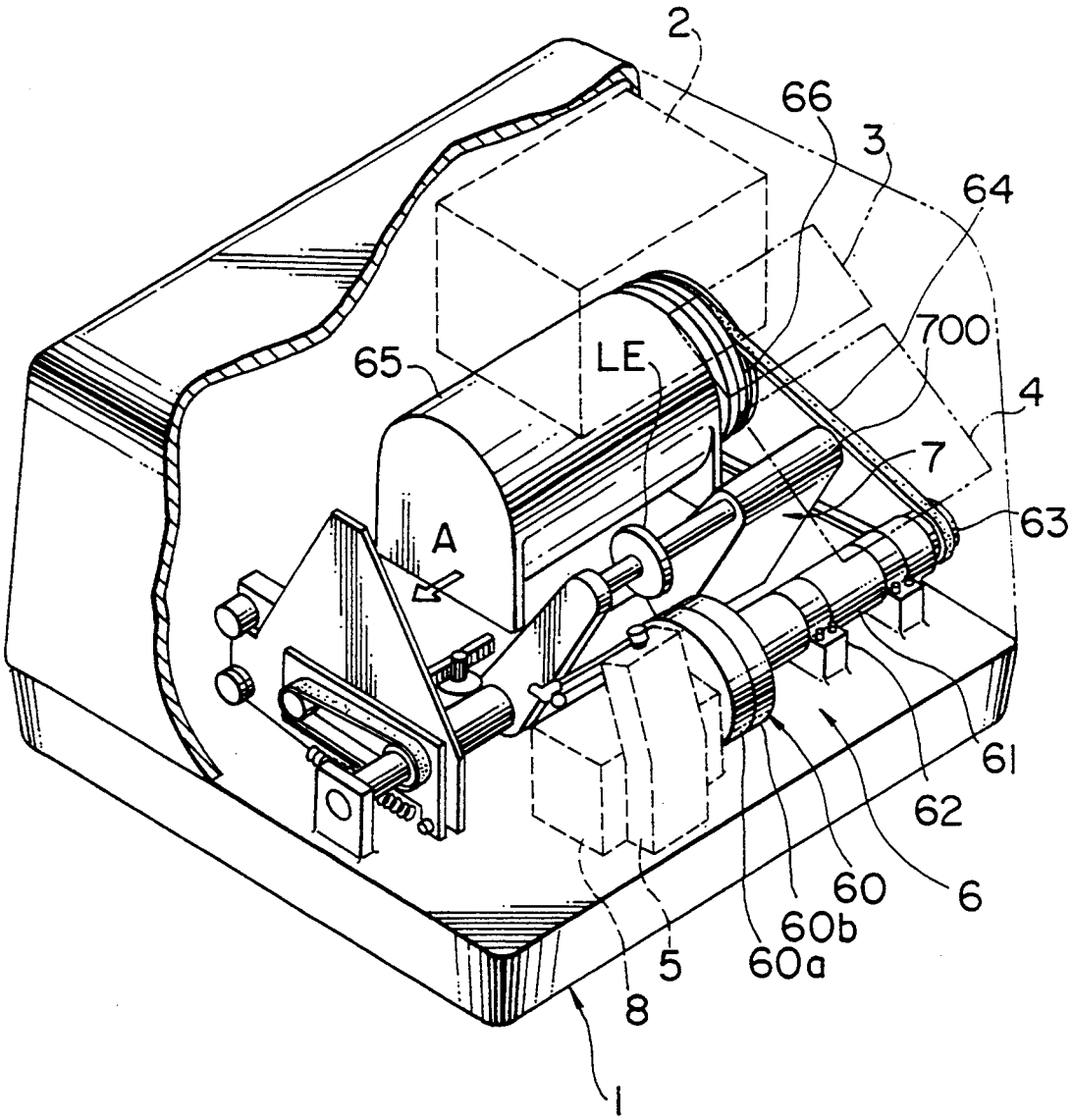
FIG. 1 is a perspective view showing the general construction of a lens grinding machine in accordance with the present invention.

FIG. 1 is a perspective view showing the general construction of an eyeglass grinding machine in accordance with the present invention.

The reference numeral 1 indicates a machine base, on which the components of the lens grinding machine are arranged.

The reference numeral 2 indicates a lens frame portion and template configuration measuring device, which is arranged in the upper section of the grinding machine.

Arranged in front of the measuring device 2 are a display section 3, through which measurement results, calculation results, etc. are displayed in the form of characters or graphics, and an input section 4, at which information/data in relation to the pupillary distance and the adjustment amount is entered or commands for selecting the V-groove curve and the V-groove position are given to the device.

Provided in the front section of the grinding machine is a lens configuration measuring device 5 for measuring the imaginary edge thickness, etc. of an unprocessed lens.

The reference numeral 6 indicates a lens grinding section, where an abrasive wheel 60, which is composed of a rough abrasive wheel **60*a* for glass lenses and a rough abrasive wheel 60*b* for plastic lenses, is rotatably mounted on a rotating shaft 61, which is attached to the base 1 by means of fixing bands 62**.

Attached to one end of the rotating shaft 61 is a pulley 63, which is linked through a belt 64 with a pulley 66 attached to the rotating shaft of an AC motor 65. Accordingly, rotation of the motor 65 causes the abrasive wheel 60 to rotate.

The reference numeral 7 indicates a carriage section, and the reference numeral 700 indicates a carriage.

The reference numeral 8 indicates a V-groove processing section including a V-groove abrasive wheel and so forth where V-groove processing and flat processing are performed. Since this processing section is little related to the present invention, its explanation will be omitted.

(2) Electrical Control System for Whole Grinding Machine

Next, an electric control system of this embodiment will be described.

Figure 27:
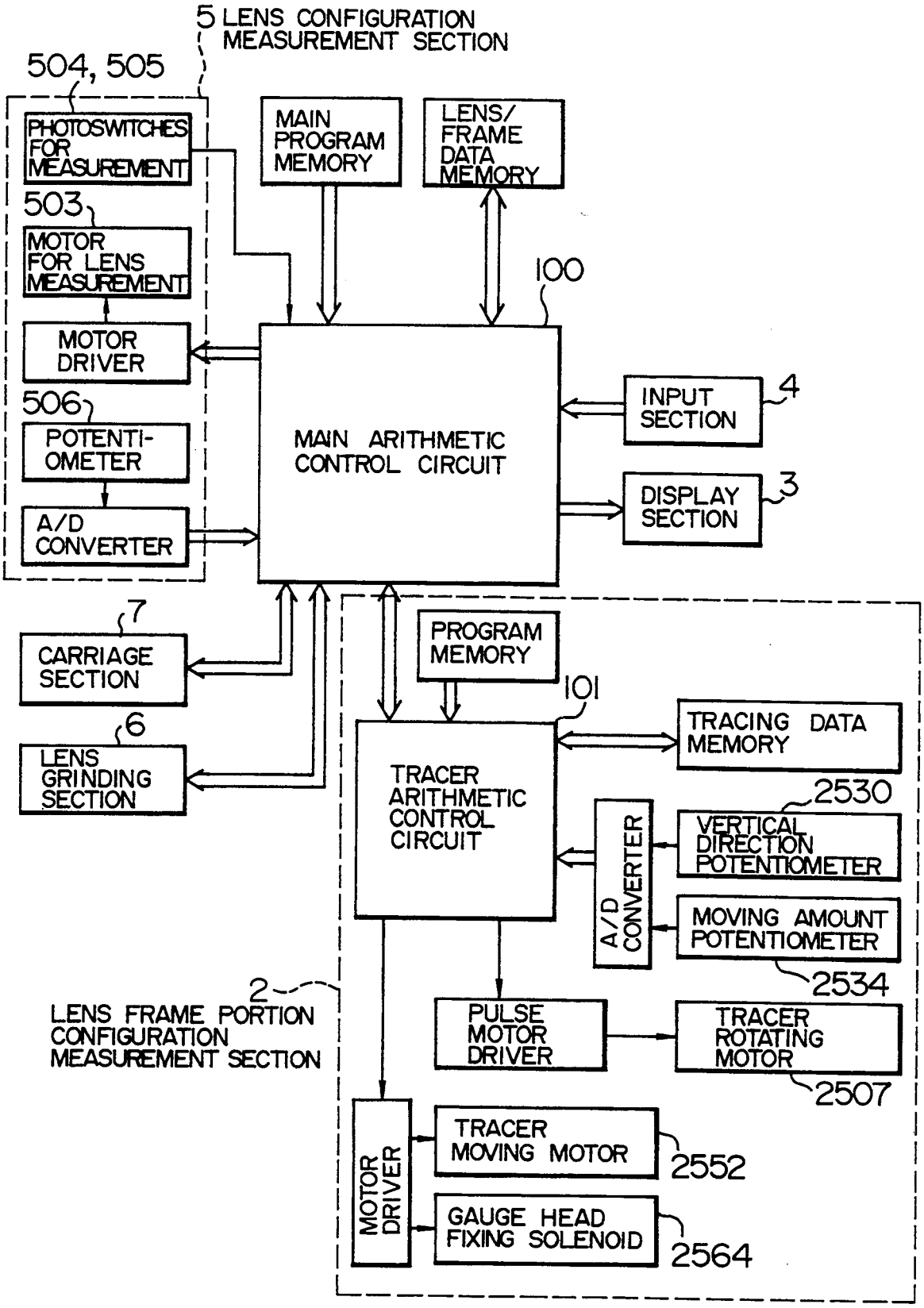
FIG. 27 is a block diagram showing an electric system of the whole grinding machine.

FIG. 27 is a block diagram showing an electric system of the whole grinding machine.

An arithmetic control circuit is divided into two sections, i.e., a main arithmetic control circuit 100 and a tracer arithmetic control circuit 101 for the sake of processing convenience.

The main arithmetic control circuit 100 is formed of, for example, a microprocessor, and it is controlled by a sequence program stored in a main program. The main arithmetic control circuit 100 performs data exchange and communication with the tracer arithmetic control circuit 101 for lens frame portions.

The display section 3 and the input section 4 are connected to the main arithmetic control circuit 100.

Photoswitches 504 and 505 for measurement are connected to the main arithmetic control circuit 100, and also, a potentiometer 506 for measuring configurations of lenses to be processed is connected to an A/D converter whose conversion results will be inputted into the main arithmetic control circuit 100. Measurement data of the lenses which have been arithmetically processed in the main arithmetic control circuit 100 are stored in a lens/frame data memory. A motor 503 for lens measurement is connected to the main arithmetic control circuit 100 through a motor driver.

The main arithmetic control circuit 100 controls the lens grinding section 6 and the carriage section 7 so as to process the lenses.

The tracer arithmetic control circuit 101 controls the operation of the lens frame portion configuration measuring section 2 and calculates processing data for lens processing on the basis of lens frame portion configuration data obtained then and the data transmitted from the main arithmetic control circuit 100.

Output of potentiometers 2530, 2534 for measuring the lens frame portion configurations is connected to an A/D converter whose conversion results will be inputted into the tracer arithmetic control circuit 101. A tracer rotating motor 2507 is controlled by the tracer arithmetic control circuit 101 through a pulse motor driver. Further, a tracer moving motor 2552 and a gauge head fixing solenoid 2564 are driven by the respective drive circuits which have received commands from the tracer arithmetic control circuit 101.

The tracer arithmetic control circuit 101 is formed of, for example, a microprocessor, and it is controlled by a sequence program stored in a program memory.

The lens frame portion configuration data thus measured are temporarily stored in a tracing data memory, converted into control data for lens processing, and transmitted to the main arithmetic control circuit 100.

(3) Lens Frame Portion and Template Configuration Measuring Section

Tracer Section

(a) Construction

The construction of a lens frame portion and template configuration measuring section 2 will be described with reference to FIGS. 2 to 9.

Figure 2:
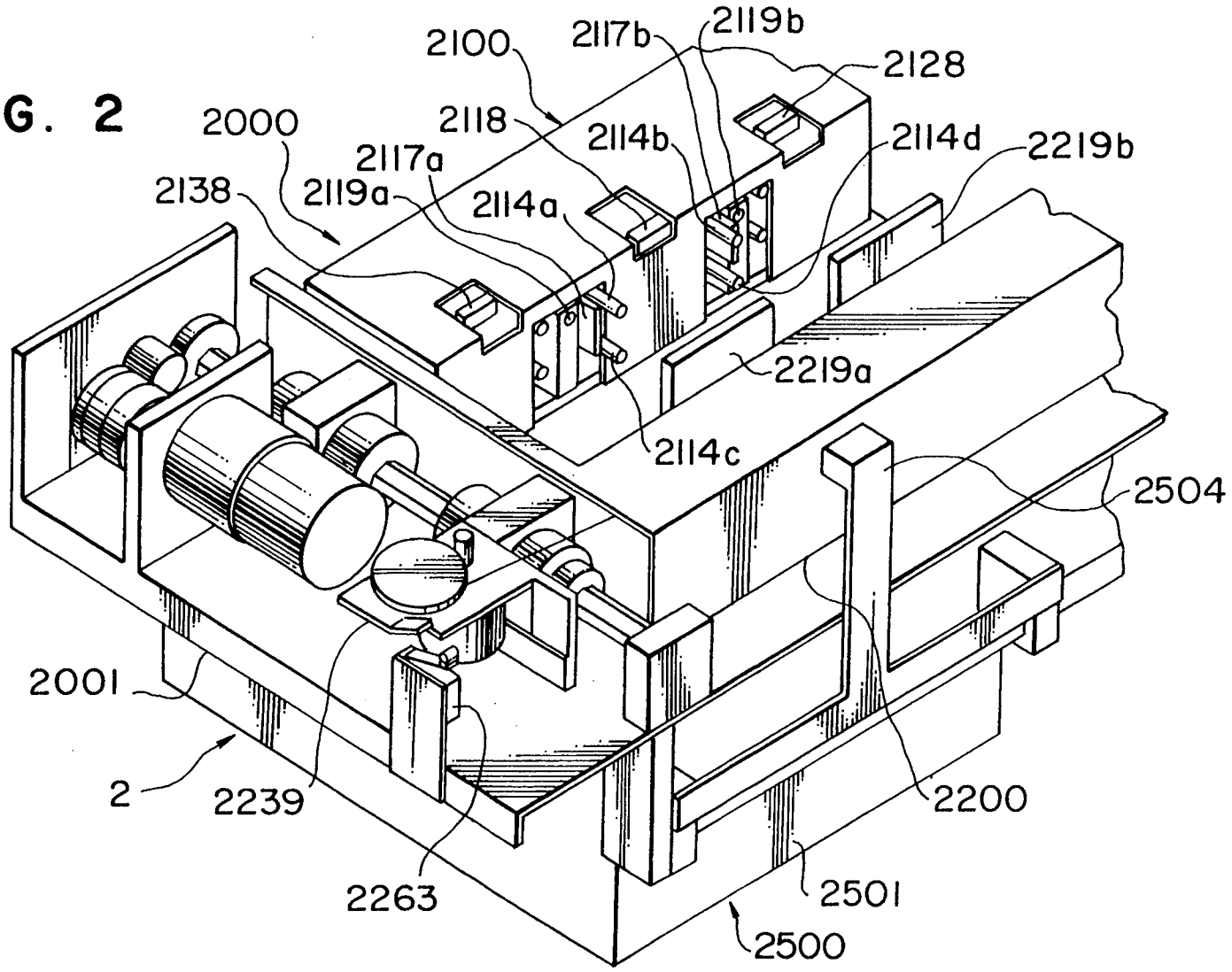
FIG. 2 is a perspective view showing a measurement section for measuring the configurations of lens frame portions and templates.

FIG. 2 is a perspective view showing a lens frame portion and template configuration measuring section in accordance with this embodiment. This section is incorporated in the body of the lens grinding machine and is generally composed of two sections: a frame and template holding section 2000 for holding a frame and templates and a measurement section 2500 for performing digital measurement of the configurations of lens frame portions in the frame and templates.

Frame Holding Section

FIGS. 3 to 8 show the construction of the frame holding section 2000.

Figure 3:
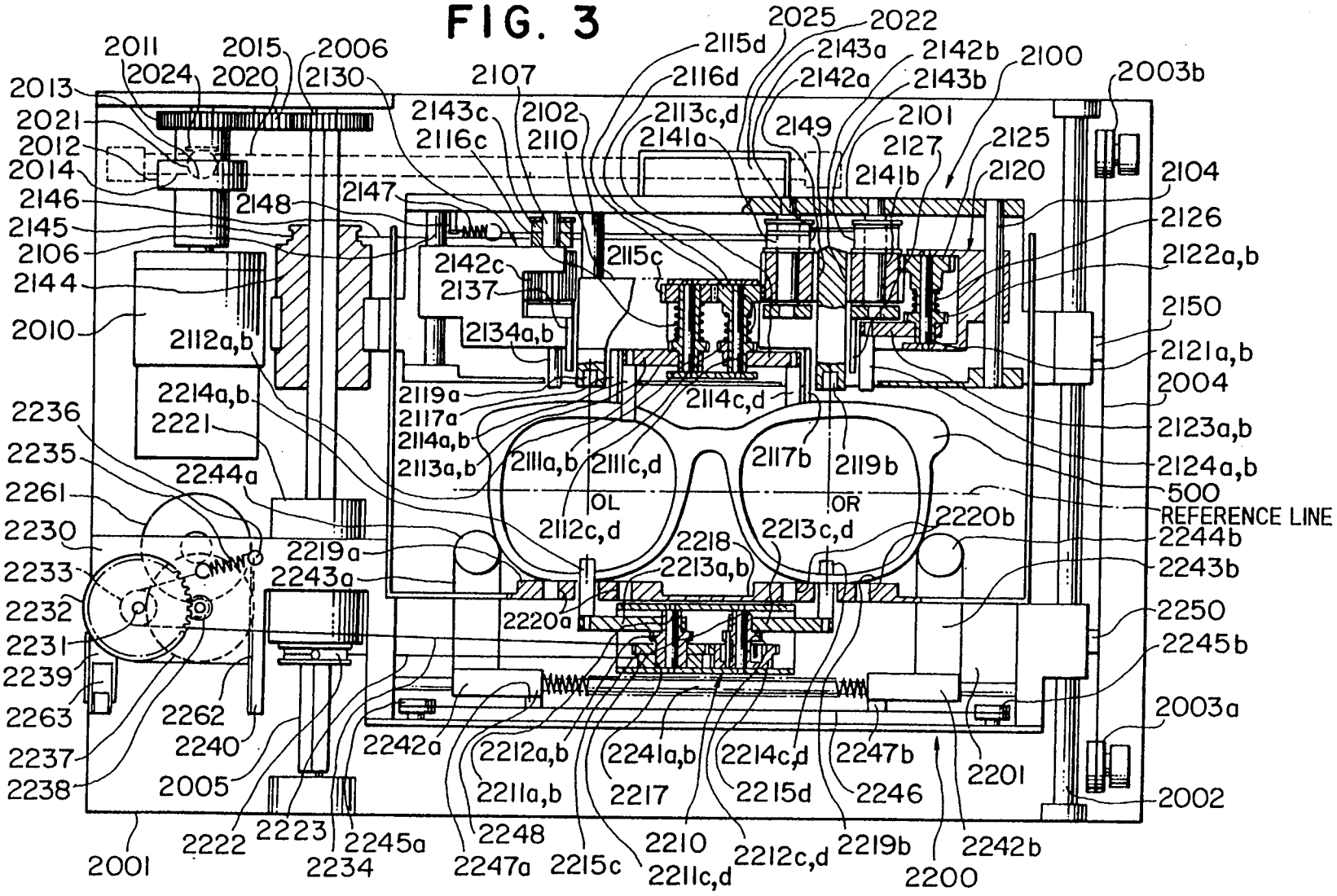
FIG. 3 is a diagram showing a frame holding section 2000.
Figure 4:
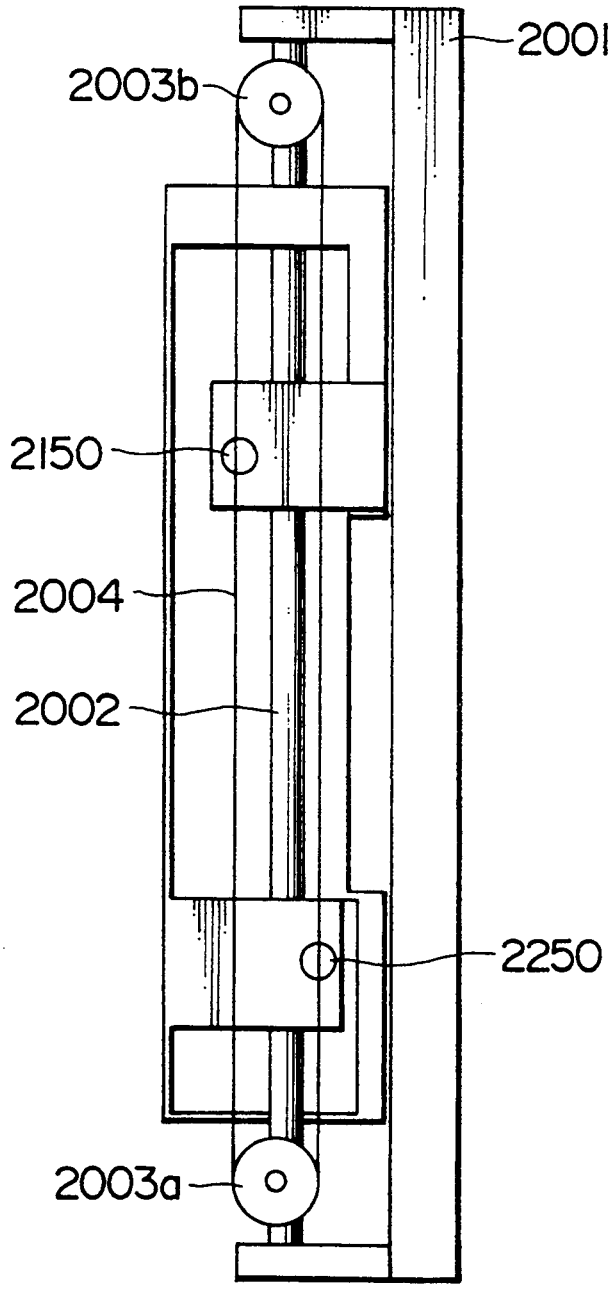
FIG. 4 is a diagram illustrating the operation of a wire 2004.
Figure 5:
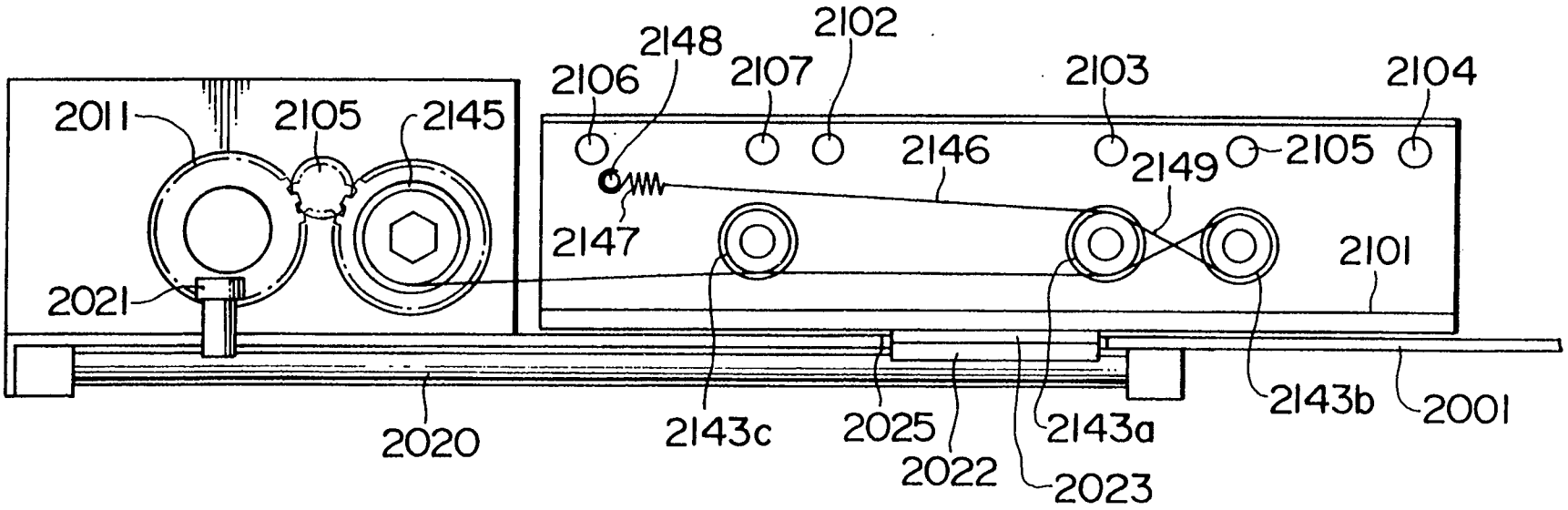
FIG. 5 is a diagram illustrating the operation of wires 2146 and 2149.
Figure 6:
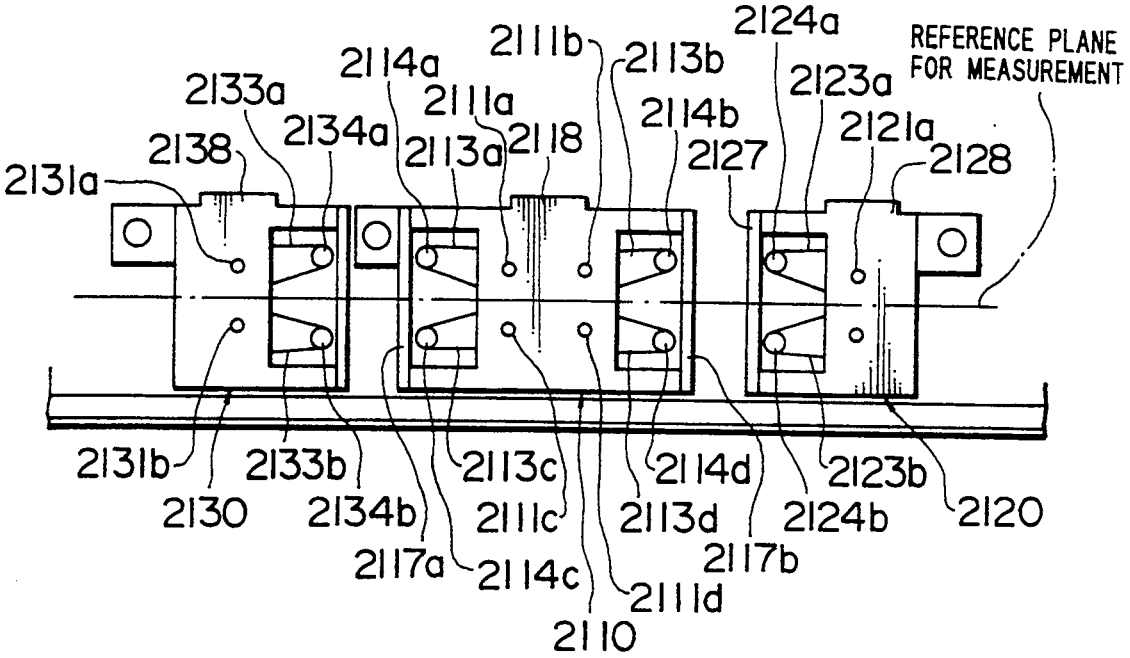
FIG. 6 is a diagram illustrating a fastening mechanism on the side of an upper slider.
Figure 7:
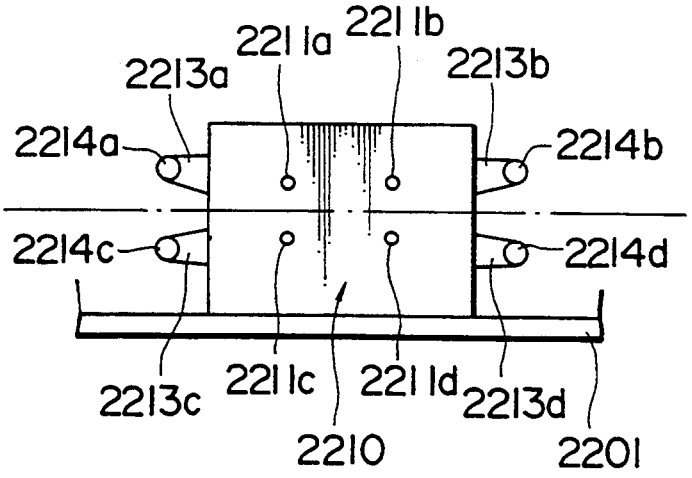
FIG. 7 is a diagram illustrating a fastening mechanism on the side of a lower slider.
Figure 8:
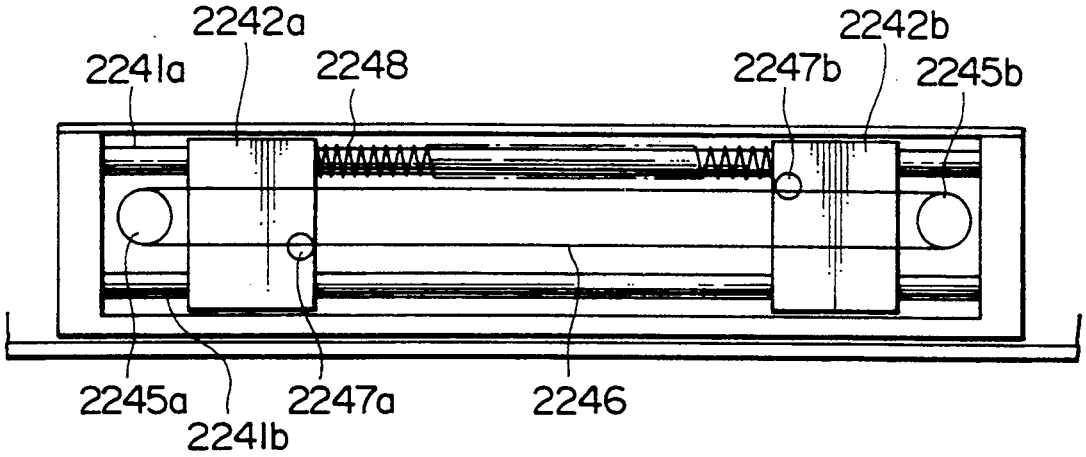
FIG. 8 is a diagram illustrating the operation of a wire 2246.

Referring to FIG. 3, the average geometrical centers of a pair of lens frame portions when the frame is set in the frame holding section 2000 are established as reference points OR and OL, and the straight line connecting these two points is regarded as a reference line. Further, the plane at a certain height as measured from the surface of a box 2001 belonging to the frame holding section 2000 is used as a reference plane for measurement.

An upper slider section 2100 and a lower slider section 2200 are arranged in such a manner as to be slidable along a guide shaft 2002 attached to the box 2001 and a guide rail 2005 having a hexagonal sectional configuration and rotatably supported on the box 2001. The upper section of a wire 2004, which is stretched between pulleys 2003*a* and 2003*b* rotatably mounted on the box 2001, is firmly attached to a pin 2150 embedded in the upper slider section 2100, and the lower section of the wire 2004 is firmly attached to a pin 2250 embedded in the lower slider section 2200, enabling these slider sections to make opposite sliding movements symmetrically with respect to the reference line.

A gear 2011 is attached to the rotating shaft of a clamping motor 2010 mounted on the box 2001. This gear 2011 is in mesh with a gear 2006 formed at one end of the guide shaft 2005 through the intermediation of an idle gear 2015, enabling the rotation of the clamping motor 2010 to be transmitted to the guide shaft 2005.

Rotatably supported on the back surface of the box 2001 is a shaft 2020, and, by means of a plate spring 2024 attached to the box 2001, a pin 2021 which is embedded in one of the end sections of the shaft 2020 is abutted against a recess 2013 of a cam 2012 formed in the middle section of the gear 2011. Attached to the other end of the shaft 2020 is a brake arm 2022, to which a brake rubber 2023 is attached. This brake rubber 2023 is exposed to the exterior through a hole 2025 of the box 2001.

When the cam 2012 is rotated by the clamping motor 2010, the pin 2021, which has been abutted against the recess 2013, is pressed by a protrusion 2014 of the cam 2012, and the shaft 2020 rotates, with the brake rubber 2023 attached to the brake arm 2022 being abutted against the back surface of the upper slider section 2100.

A top center clamp 2110 is slidably placed on shafts 2102 and 2103 mounted on the base 2101 of the upper slider section 2100. Likewise, a right clamp 2120 is slidably placed on shafts 2104 and 2105, and a left clamp 2130 on shafts 2106 and 2107.

Shafts 2111*a*, 2111*b*, 2111*c* and 2111*d* are rotatably supported by the top center clamp 2110. Rotatably mounted on the shafts 2111*a* and 2111*b* are gears 2112*a* and 2112*b*, respectively, to which one end of an arm 2113*a* and one end of an arm 2113*b* are respectively attached. Clamping pins 2114*a* and 2114*b* are respectively attached to the other ends of the arms 2113*a* and 2113*b*.

Rotatably mounted on the shafts 2111*c* and 2111*d* are gears 2112*c* and 2112*d*, to which one end of an arm 2113*c* and one end of an arm 2113*d* are respectively attached. Clamping pins 2114*c* and 2114*d* are respectively attached to the other ends of the arms 2113*c* and 2113*d*.

Further, rotatably attached to the shafts 2111*c* and 2111*d* are other gears 2115*c* and 2115*d*, which are integrally connected with the gears 2112*c* and 2112*d* through the intermediation of torsion coil springs 2116*c* and 2116*d*.

In the above arrangement, the gears 2112*a*, 2112*b*, and 2115*c* are in mesh with the gears 2112*c*, 2112*d*, and 2115*d*, respectively. By rotating the gear 2115*d*, the two pairs of opposed clamp pins: 2114*a* and 2114*c*; and 2114*b* and 2114*d*, respectively make opposite rotations symmetrically with respect to the reference plane for measurement.

Further, frame supports 2117*a* and 2117*b* are respectively attached to each end of the top center clamp 2110, at positions in close proximity to the clamp pin pairs: 2114*a* and 2114*c*; and 2114*b* and 2114*d*, and perpendicular to the reference plane for measurement. A tab 2118 is provided in the upper portion of the top center clamp 2110.

Respectively arranged on each side of the top center clamp 2110 are holes 2119*a* and 2119*b* formed in the base 2101.

Shafts 2121*a* and 2121*b* are rotatably supported by the right clamp 2120, and, rotatably mounted on the shaft 2121*a* is a gear 2122*a* to which one end of an arm 2123*a* is firmly attached, and, further, attached to the other end of the arm 2123*a* is a clamp pin 2124*a*.

Rotatably mounted on the shaft 2121*b* is a gear 2122*b*, to which one end of an arm 2123*b* is firmly attached, and, attached to the other end of the arm 2123*b* is a clamp pin 2124*b*.

Further, rotatably attached to the shaft 2121*b* is another gear 2125, which is integrally connected with the gear 2122*b* through the intermediation of a torsion coil spring 2126.

In the above arrangement, the gears 2122*a* and 2122*b* are in mesh with each other, and, by rotating the gear 2125, the clamp pins 2224*a* and 2224*b* make opposite rotations symmetrically with respect to the reference plane for measurement.

Further, a frame support 2127 is attached to the right clamp 2120, at a position in close proximity to the clamp pins 2124*a* and 2124*b* and perpendicular to the reference plane for measurement. A tab 2128 is provided in the upper portion of the right clamp 2120.

Shafts 2131*a* and 2131*b* are rotatably supported by the left clamp 2130. Rotatably mounted on the shaft 2131*a* is a gear 2132*a* (not shown), to which one end of an arm 2133*a* is firmly attached, and, attached to the other end of the arm 2133*a* is a clamp pin 2134*a*.

Rotatably mounted on the shaft 2131*b* is a gear 2132*b* (not shown), to which one end of an arm 2133*b* is firmly attached, and, attached to the other end of the arm 2133*b* is a clamp pin 2134*b*.

Further, rotatably mounted on the shaft 2131*b* is another gear 2135 (not shown), which is integrally connected with the gear 2132*b* through the intermediation of a torsion coil spring 2136 (not shown).

In the above arrangement, the gears 2132*a* and 2132*b* are in mesh with each other, and, by rotating the gear 2135, the clamp pins 2134*a* and 2134*b* make opposite rotations symmetrically with respect to the reference plane for measurement.

Further, a frame support 2137 is attached to the left clamp 2130, at a position in close proximity to the clamp pins 2134*a* and 2134*b* and perpendicular to the reference plane for measurement, and a tab 2138 is provided in the upper portion of the left clamp 2130.

A gear 2142*a* and a pulley 2143*a* are integrally attached to a shaft 2141*a* which is rotatably supported by the base 2101 of the upper slider section 2100, with the gear 2142*a* being in mesh with the gear 2115*d*. Likewise, gears 2142*b* and 2142*c* and pulleys 2143*b* and 2143*c* are respectively integrally attached to a shaft 2141*b* and a shaft 2141*c* (not shown), with the gears 2142*b* and 2142*c* being in mesh with the gears 2125 and 2135, respectively.

Further, the gears 2142*a*, 2142*b*, and 2142*c* are sufficiently long in the axial direction and capable of being constantly in mesh with the gears 2115*d*, 2125, and 2135 within the sliding range of the top center clamp 2110, the right clamp 2120, and the left clamp 2130.

A hexagonal shaft hole of a holder 2144, which is rotatably supported by the base 2101 of the upper slider section 2100, is engaged with the guide rail 2005, whereby the holder 2144 is prevented from rotating around the guide rail 2005.

A pulley 2145 is formed on the holder 2144.

A wire 2146 whose one end is firmly attached to the pulley 2145 is passed around pulleys 2143*c* and 2143*a*, the other end of the wire 2146 being hooked on a pin 2148, which is embedded in the base 2101, through the intermediation of a spring 2147.

A wire 2149 is stretched between the pulleys 2143*a* and 2143*b* in such a manner as to cross each other diagonally.

In the above-described construction of the upper slider section 2100, the rotation of the clamping motor 2010 is transmitted to the guide shaft 2005, and, when the pulley 2145 formed on the holder 2144 rotates, the gears 2142*a*, 2142*b*, and 2142*c* rotate through the wires 2146 and 2149, with all the clamp pin pairs; 2114*a* and 2114*c*; 2114*b* and 2114*d*; 2124*a* and 2124*b*; and 2134*a* and 2134*b* making opposite rotations symmetrically with respect to the reference plane for measurement.

Shafts 2211*a*, 2211*b*, 2211*c*, and 2211*d* are rotatably supported by the lower center clamp 2210, which is attached to the base 2201 of the lower slider section 2200. Rotatably mounted on the shafts 2211*a* and 2211*b* are gears 2212*a* and 2212*b*, respectively, to which one end of an arm 2213*a* and one end of an arm 2213*b* are respectively firmly attached, and clamp pins 2214*a* and 2214*b* are attached to the respective other ends of the arms 2213*a* and 2213*b*. Rotatably mounted on the shafts 2211*c* and 2211*d* are gears 2212*c* and 2212*d*, to which one end of an arm 2213*c* and one end of an arm 2213*d* are respectively firmly attached and clamp pins 2214*c* and 2214*d* are attached to the respective other ends of the arms 2213*c* and 2213*d*.

Further, rotatably mounted on the shafts 2211*c* and 2211*d* are other gears 2215*c* and 2215*d*, which are integrally connected with the gears 2212*c* and 2212*d* through the intermediation of torsion coil springs 2216*c* and 2216*d* (not shown).

The torsion coil springs 2116*c*, 2116*d*, 2126, 2136, 2216*c*, and 2216*d* are provided with a view to protecting the eyeglass frame from being damaged when i t is clamped.

In the above arrangement, the gears 2212*a*, 2212*b*, and 2215*c* are in mesh with the gears 2212*c*, 2212*d*, and 2215*d*, respectively, and, by rotating the gear 2215*c*, the clamp pin pairs: 2214*a* and 2214*c*; and 2214*b* and 2214*d* make opposite rotations symmetrically with respect to the reference plane for measurement.

Further, a frame support 2219*a* having mounting holes 2220*a*, and a frame support 2219*b* having mounting holes 2220*b*, are formed on the base 2201 in such a manner as to be parallel to the reference line.

A hexagonal shaft hole of a holder 2221, which is rotatably supported by the base 2201 of the lower slider section, is engaged with the guide rail 2005, whereby the holder 2221 is prevented from rotating around the guide rail 2005.

A pulley 2222 is formed on the holder 2221.

One end of a wire 2223 is firmly attached to the pulley 2222, with the other end thereof being firmly attached to a pulley 2218 formed on the gear 2215*c*.

A pulley 2233 is formed in the lower section of a gear 2232, which is rotatably supported by a pin 2231 embedded in an arm 2230 that is formed on the base 2201 of the lower slider section 2200. A wire 2234 whose one end is firmly attached to a pulley 2217 formed on the gear 2212*a* is wound around a pulley 2233, with the other end of the wire 2234 being hooked on a pin 2236, which is embedded in the arm 2230, through the intermediation of a spring 2235.

Further, attached to the arm 2230 is a potentiometer 2237, to the rotating shaft of which is firmly attached a gear 2238.

This gear 2238 is in mesh with the gear 2232 and is capable of transmitting the moving amount of the clamp pin 2214*a* to the potentiometer 2237 through the wire 2234.

Attached to the base 2201 of the lower slider section 2200 are shafts 2241*a* and 2241*b*, on which are slidably placed a left slider 2242*a* and a right slider 2242*b*.

A left frame pressing member 2244*a* having a cylindrical configuration is attached to the tip end of an arm 2243*a* extending from the left slider 2242*a*, in such a position as to be perpendicular to the reference plane for measurement, and, likewise, a right frame pressing member 2244*b* having a cylindrical configuration is attached to the tip end of an arm 2243*b* extending from the right slider 2242*b*, in such a position as to be perpendicular to the reference plane for measurement.

The lower section of a wire 2246 stretched between pulleys 2245*a* and 2245*b*, which are rotatably mounted on the base 2201, is firmly attached to a pin 2247*a* embedded in the left slider 2242*a*, and the upper section of the wire 2246 is firmly attached to a pin 2247*b* embedded in the right slider 2242*b*, whereby opposite sliding movement can be made symmetrically with respect to the center line connecting the points OR and OL. The two ends of a spring 2248 are respectively firmly attached to the left and right sliders 2242*a* and 2242*b*, whereby these sliders are constantly pulled towards the center.

While in this embodiment the left and right sliders 2242*a* and 2242*b* are constantly pulled towards the center by the spring 2248, this structure should not be construed as restrictive.

For example, the positional adjustment of the left and right sliders 2242*a* and 2242*b* may also be effected by driving the pulleys 2245*a* and 2245*b* by a motor (not shown).

Rotatably supported by the box 2001 is a drum 2261, around which a constant torque spring 2262 is wound. One end of this constant torque spring 2262 is firmly attached to an arm 2240 formed on the base 2201 of the lower slider section 2200, whereby the upper and lower sliders 2100 and 2200 are constantly biased towards the center.

Measurement Section

Figure 9:
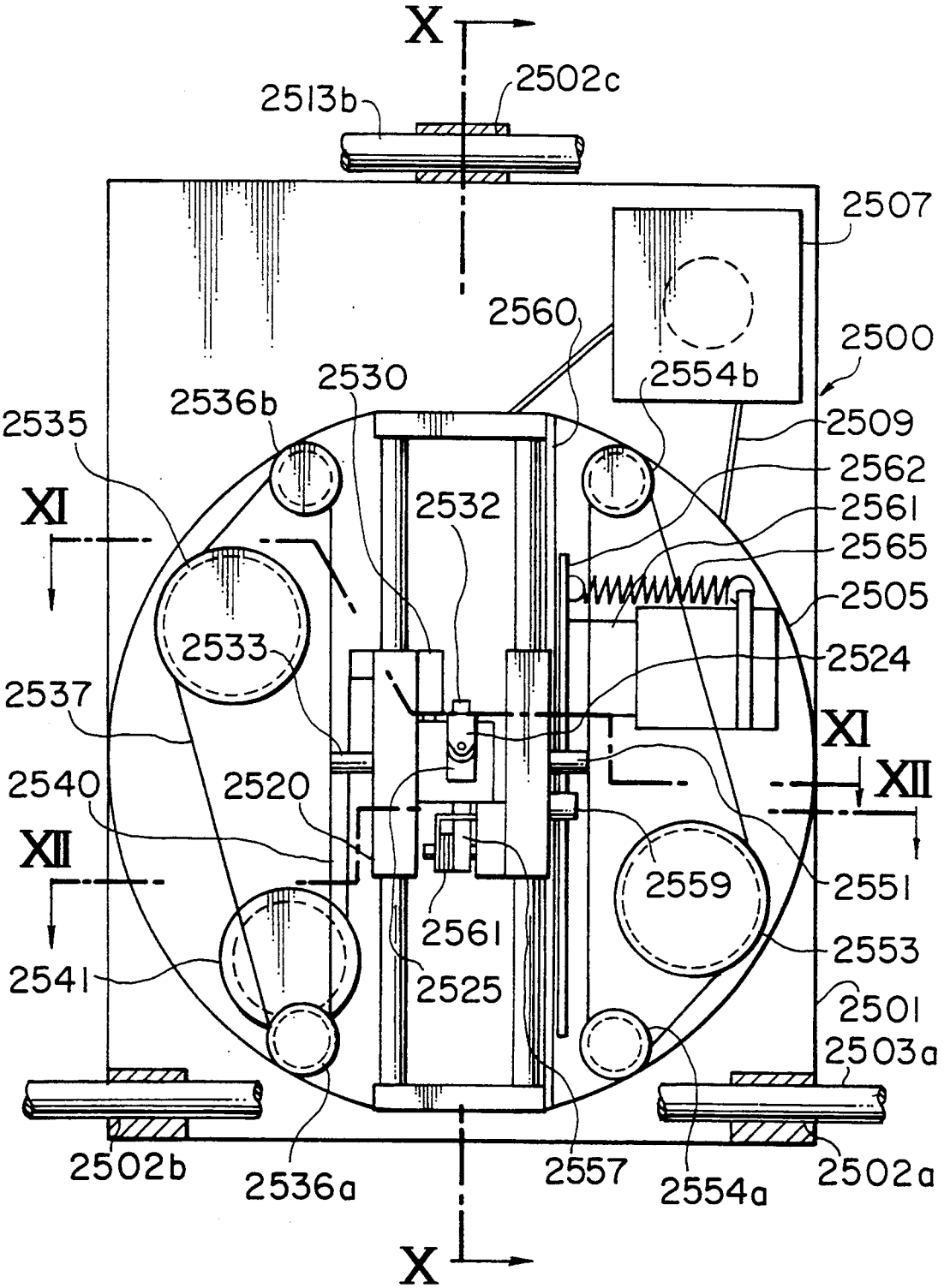
FIG. 9 is a plan view of the measurement section.
Figure 10:
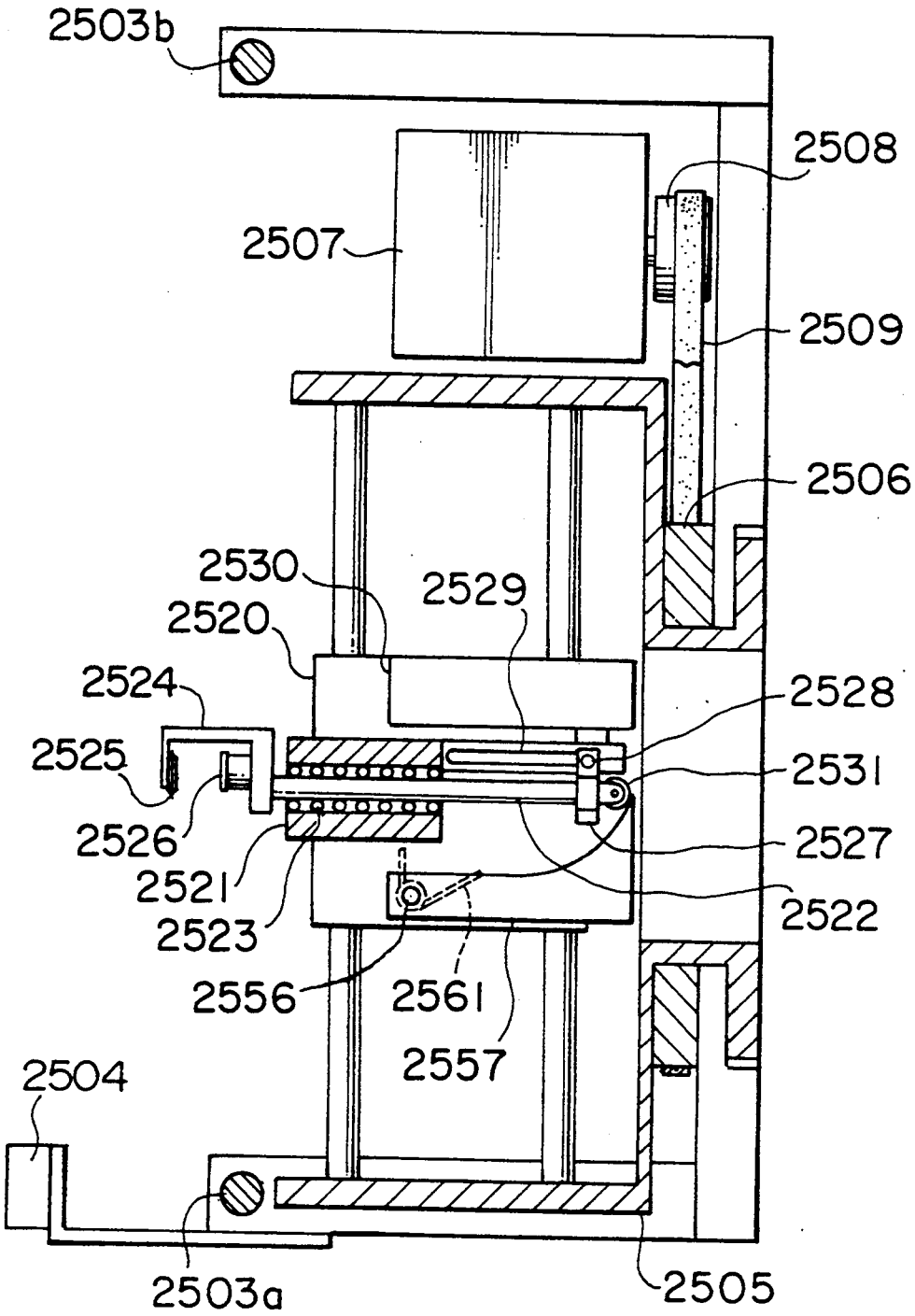
FIG. 10 is a sectional view taken along the line X—X of FIG. 9.
Figure 11:
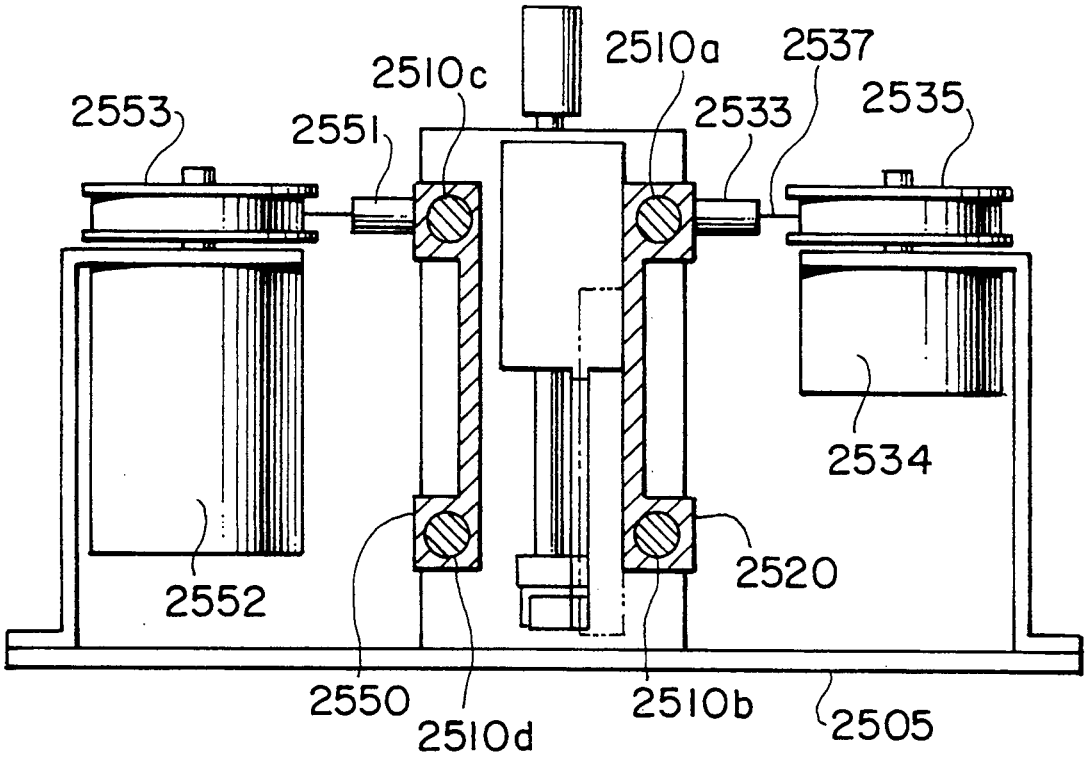
FIG. 11 is a sectional view taken along the line XI—XI of FIG. 9.
Figure 12:
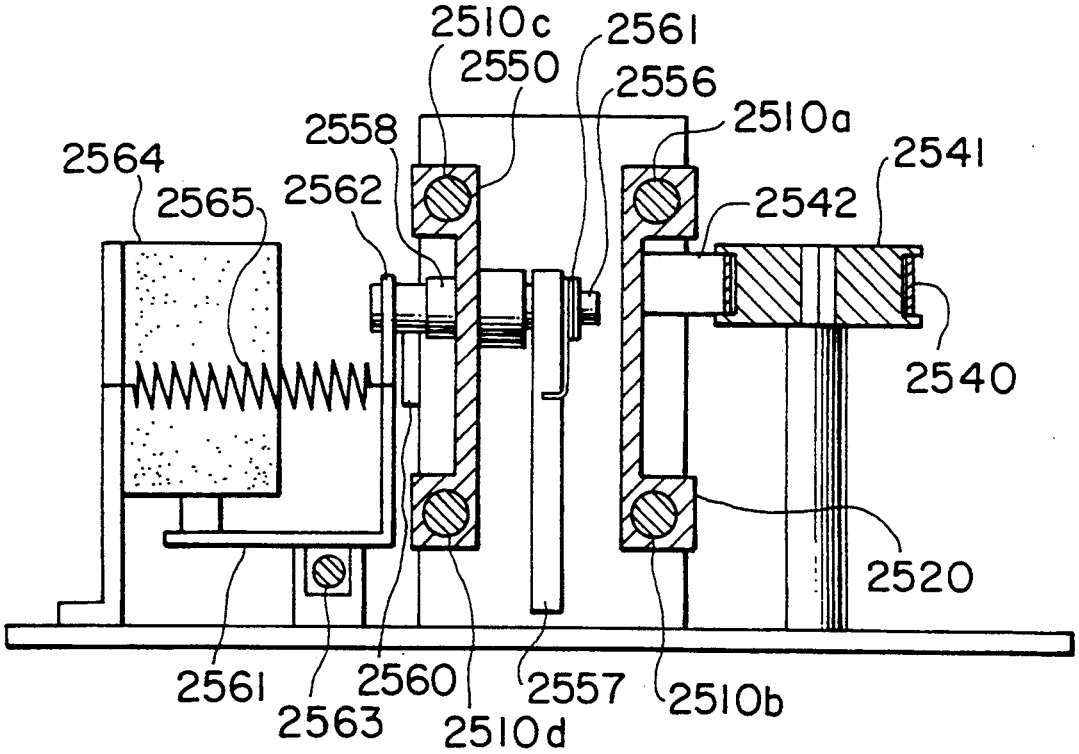
FIG. 12 is a sectional view taken along the line XII—XII of FIG. 9.

Next, the construction of the measurement section 2500 will be described with reference FIGS. 9 to 12. FIG. 9 is a plan view of the measurement section, and FIGS. 10, 11, and 12 are sectional views taken along the lines X—X, XI—XI, and XII—XII, respectively, of FIG. 9.

A movable base 2501 has shaft holes 2502*a*, 2502*b*, and 2502*c* and is slidably supported by shafts 2503*a* and 2503*b* attached to the box 2001. Further, embedded in the movable base 2501 is a lever 2504, by means of which the movable base 2501 can be slid, thereby bringing the rotational center of a rotating base 2505 to the positions OR and OL on the frame holding section 2300. The rotating base 2505, on which a pulley 2506 is formed, is rotatably supported by the movable base 2501. Stretched between the pulley 2506 and a pulley 2508, which is attached to the rotating shaft of a pulse motor 2507 mounted on the movable base 2501, is a belt 2509, by means of which the rotation of the pulse motor 2507 is transmitted to the rotating base 2505.

As shown in Fig, 11, four rails 2510*a*, 2510*b*, 2510*c*, and 2510*d* are attached to the rotating base 2505. A gauge head section 2520 is slidably mounted on the rails 2510*a* and 2510*b*. Formed in this gauge head section 2520 is a vertical shaft hole 2521, into which a gauge head shaft 2522 is inserted.

A ball bearing 2523 is provided between the gauge head shaft 2522 and the shaft hole 2521, whereby the vertical movement and the rotation of the gauge head shaft 2522 are smoothed. Attached to the upper end of the gauge head shaft 2522 is an arm 2524, and, rotatably supported by the upper section of this arm 2524 is an abacus-bead-like V-gauge head 2525 adapted to abut against the V-shaped groove of the lens frame portions.

While in this embodiment an abacus-bead-like V-gauge head 2525 is rotatably supported, this should not be construed as restrictive. The V-gauge head 2525 may also be unrotatable, and, as long as its tip section is formed abacus-bead like, its configuration need not be disc-like.

A cylindrical template measurement roller 2526 which is adapted to abut against the edge of a template is rotatably supported by the lower section of the arm 2524. The outer peripheral surfaces of the V-gauge head 2525 and the template measurement roller 2526 are located in the center line of the gauge head shaft 2522.

In a position below the gauge head shaft 2522, a pin 2528 is embedded in a ring 2527 which is rotatably mounted on the gauge head shaft 2522, with the movement in the rotating direction of this pin 2528 being limited by an elongated hole 2529 formed in the gauge head section 2520. Attached to the tip end of the pin 2528 is the movable section of a potentiometer 2530 of the gauge head section 2520, the moving amount in the vertical direction of the gauge head shaft 2522 being detected by means of this potentiometer 2530.

A roller 2531 is rotatably supported by the lower end section of the gauge head shaft 2522.

A pin 2533 is embedded in the gauge head section 2520, and a pulley 2535 is attached to the shaft of a potentiometer 2534 which is attached to the rotating base 2505. Pulleys 2536*a* and 2536*b* are rotatably supported by the rotating base 2505, and a wire 2537 which is firmly attached to the pin 2533 is stretched between these pulleys 2536*a* and 2536*b* and is wound around the pulley 2535. Thus, the moving amount of the gauge head section 2520 is detected by the potentiometer 2534.

Further, a constant torque spring 2540 which is adapted to constantly pull the gauge head section 2520 toward the side of tip of the arm 2524 is attached to a drum 2541 which is rotatably supported by the rotating base 2505, one end of the constant torque spring 2540 being firmly attached to a pin 2542 embedded in the gauge head section 2520.

Slidably mounted on the rails 2510*c* and 2510*d* on the rotating base 2505 is a gauge head driving section 2550, in which a pin 2551 is embedded, and a pulley 2553 is attached to the rotating shaft of a motor 2552 attached to the rotating base 2505. Pulleys 2554*a* and 2554*b* are rotatably supported by the rotating base 2505, and a wire 2555 firmly attached to a pin 2551 is stretched between these pulleys 2554*a* and 2554*b* and is wound around the pulley 2553, whereby the rotation of the motor 2552 is transmitted to the gauge head driving section 2550.

The gauge head driving section 2550 abuts against the gauge head section 2520, which is pulled towards the gauge head driving section 2550 by the constant torque spring 2540, and, by moving the gauge head driving section 2550, the gauge head section 2520 can be moved to a predetermined position.

Further, rotatably supported by the gauge head driving section 2550 is a shaft 2556, one end of which has an arm 2557 abutting against the roller 2531 that is rotatably supported by the lower end section of the gauge head shaft 2522, and the other end of which is attached an arm 2558 rotatably supporting a roller 2559. One end of a torsion coil spring 2561 is hooked on the arm 2557 in such a manner that the roller 2559 comes to abut against a stationary guide plate 2560 which is firmly attached to the rotating base 2505, and the other end of this torsion coil spring 2561 is firmly attached to the gauge head driving section 2550, so that, when the gauge head driving section 2550 moves, the roller 2559 moves in the vertical direction along the guide plate 2560.

The vertical movement of the roller 2559 causes the shaft 2556 to rotate, and the arm 2557 firmly attached to the shaft 2556 also rotates round the shaft 2556, causing the gauge head shaft 2522 to move in the vertical direction. Rotatably mounted on the rotating base 2505 is a shaft 2563, to which a movable guide plate 2561 is firmly attached. One end of the sliding shaft of a solenoid 2564 mounted on the rotating base 2505 is attached to a movable guide plate 2562. One end of a spring 2565 is hooked on the rotating base 2505, and the other end thereof is hooked on the movable guide plate 2562, normally pulling the guide plate 2562 to a position where its guide section does not abut against the roller 2559. When the solenoid 2564 operates to pull up the movable guide plate 2562, the guide section of this movable guide plate 2562 moves to a position where it is parallel to the stationary guide plate 2560, allowing the roller 2559 to abut against the guide section and move along the guide plate 2562.

(b) Operation

Next, the operation of the above-described lens frame portion and template configuration measurement device 2 will be described with reference to FIGS. 2 to 17.

Measurement of Lens Frame Portion Configuration

First, the operation of measuring an eyeglasses frame will be described.

Either the left or the right lens frame portion of the eyeglasses frame 500 is selected for measurement, and the measurement section 2500 is moved to the measurement side by means of a lever 2504 which is firmly attached to the movable base 2501.

The frame holding section of the present device is capable of both horizontal holding and one lens frame portion holding of the frame. In the following, the horizontal holding operation will be described.

By pulling the tab 2118 formed on the top center clamp 2110 of the upper slider section 2100 and inwardly pushing the tabs 2128 and 2138 of the right and left clamps 2120 and 2130, only the frame supports 2117*a* and 2117*b* and the clamp pins 2114*a*, 2114*b*, 2114*c*, and 2114*d* of the top center clamp 2110 are set ready for use, whereas the frame support 2127 and the clamp pins 2124*a* and 2124*b* of the right clamp 2120 and the frame support 2137 and the clamp pins 2134*a* and 2134*b* of the left clamp 2130 remain lodged inside. In this condition, the opening degree of the clamp pins is maximum.

Next, the right and left frame pressing members 2244*a* and 2244*b* are moved away from each other, and, at the same time, the lower slider section 2200 is pulled so as to enlarge the distance between the upper and lower slider sections 2100 and 2200 to a sufficient degree. The front section of eyeglasses frame is positioned between the clamp pin pairs: 2114*a* and 2114*c*; and 2114*b* and 2114*d*, of the upper slider section 2100, and is abutted against the frame supports 2117*a* and 2117*b*. Then, the distance between the upper and lower slider sections 2100 and 2200 is diminished, positioning the lower frame sections between the clamp pin pairs: 2214*a* and 2214*c*; and 2214*b* and 2214*d*, of the lower slider section 2200, abutting them against the frame supports 2219*a* and 2219*b*. Afterwards, the distance between the right and left frame pressing members 2244*a* and 2244*b* is reduced, abutting them against the sides of the eyeglasses frame.

In this embodiment, the constant torque spring 2262 and the spring 2248 are constantly exerting a centripetal force on the upper and lower slider sections 2100 and 2200 and the left and right frame pressing members 2244*a* and 2244*b*, and, by holding the eyeglasses frame by the upper and lower slider sections 2100 and 2200 and the left and right frame pressing members 2244*a* and 2244*b*, the horizontal center of the frame can be retained at the middle point between the points OR and OL.

When a tracing switch in the input section 4 described below is depressed with the frame set as described above, the brake rubber 2023 comes to abut against the back surface of the upper slider section 2100 due to the action of the clamping motor 2010, with the lower slider section 2200 being secured in position through the upper slider section 2100 and the wire 2004. Afterwards, the clamp pin pairs: 2114*a* and 2114*c*; and 2114*b* and 2114*d*, of the upper slider section 2100, and the clamp pin pairs: 2214*a* and 2214*c*; and 2214*b* and 2214*d* of the lower slider section 2200, are closed and abut against the frame. Further, when the clamping motor 2010 rotates, the clamp pin pairs: 2114*a* and 2114*c*; 2114*b* and 2114*d*; 2214*a* and 2214*c*; and 2214*b* and 2214*d*, are strongly pressed against the frame due to the action of the torsion coil springs 2116*c*, 2116*d*, 2216*c*, and 2216*d*, thereby securing the frame in position.

In the case of one lens frame portion holding, for example, right lens frame portion holding, the center clamp 2110 and the right clamp 2120 of the upper slider section 2100 are pulled out, securing the right side of the frame in position by means of the clamp pins 2114*b* and 2114*d* of the top center clamp 2110, the clamp pins 2124*a* and 2124*b* of the right clamp 2120, and the clamp pins 2214*b* and 2214*d* of the lower center clamp 2210 of the lower slider 2200. In the case of left lens frame portion holding, the left clamp 2130 is used.

Figure 13:
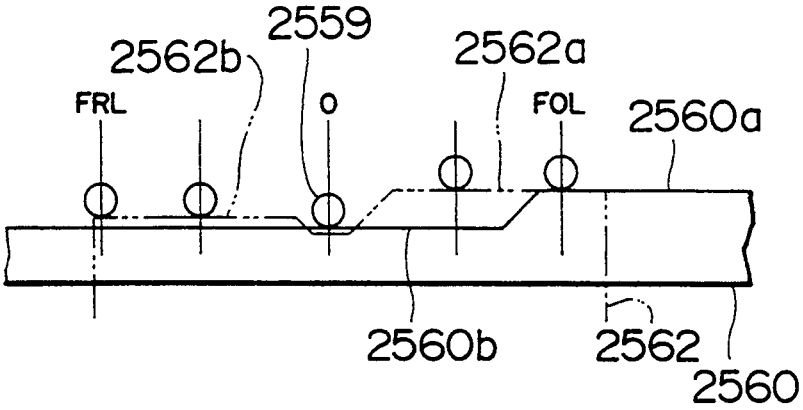
FIGS. 13 and 14 are diagrams illustrating the vertical movement of a gauge head.
Figure 14:
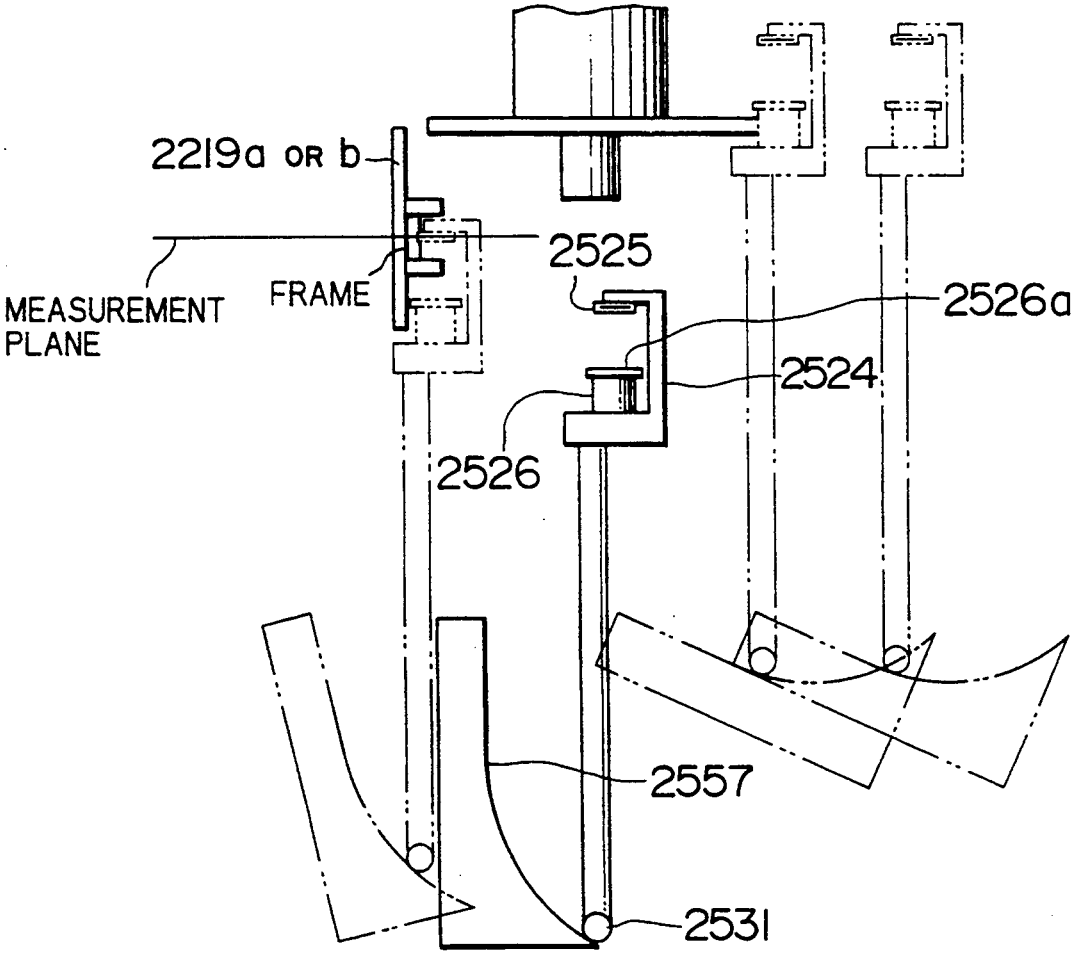

In FIGS. 13 and 14, the roller 2559 of the gauge head driving section 2550 is at the reference position O, and the pulse motor 2507 is rotated a predetermined angle, turning the rotating base 2505 such that the moving direction of the gauge head driving section 2550 becomes perpendicular to the reference line.

Subsequently, the guide section of the movable guide plate 2562 is moved to a predetermined position by the solenoid 2564, and the gauge head driving section 2550 is moved in the direction of the lower slider 2200. This causes the roller 2559 to move from the guide section 2560*a* of the stationary guide plate 2560 to the movable guide plate 2562*b*, and the gauge head shaft 2522 is raised by the arm 2557, with the V-gauge head 2525 being retained at the level of the reference plane for measurement.

Further, when the gauge head driving section 2550 is moved, the V-gauge head 2525 is inserted into the V-groove of the lens frame portion, and the gauge head section 2520 stops its movement, the gauge head driving section 2550 moving to FRL to stop there.

Subsequently, the pulse motor 2507 is rotated each time by a unit rotation pulse number which has previously been set. At this time, the gauge head section 2520 moves along the guide shaft 2510*a* and 2510*b* in accordance with the radius vector of the lens frame portion, the amount of this movement being read by the potentiometer 2534. The gauge head shaft 2522 moves up and down following the curve of the lens frame portion, the amount of this movement being read by the potentiometer 2530. From the rotation angle $\theta$ of the pulse motor 2507, the read amount r of the potentiometer 2534, and the read amount z of the potentiometer 2530, the lens frame portion configuration is measured as (rn, $\theta$n, zn) (n=1, 2, .. . , N).

(4) Unprocessed Lens Configuration Measuring Section (a) Construction

Figure 18:
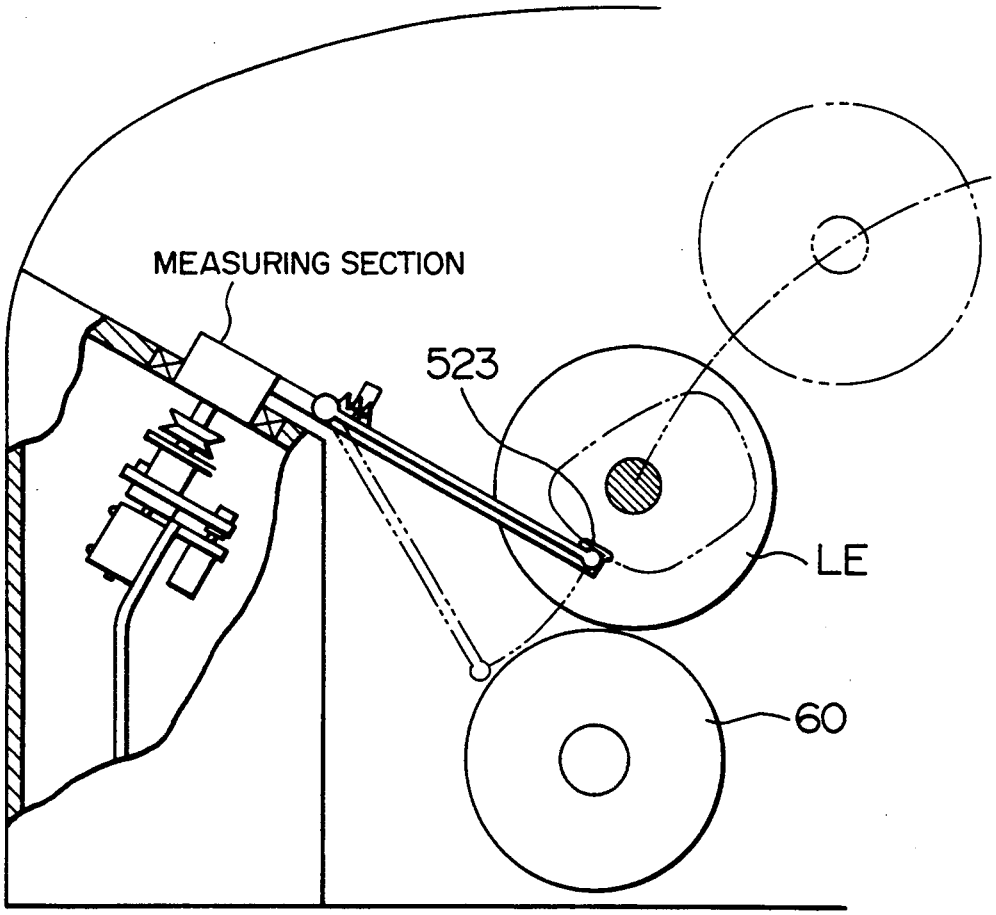
FIG. 18 is a schematic diagram showing the general construction of an unprocessed lens configuration measuring section.

FIG. 18 is a schematic diagram showing the general construction of the unprocessed lens configuration measuring section for detecting, prior to the grinding, the curve value, the edge thickness, etc. of the lens polished under predetermined conditions. The construction of this measuring section will be described in detail with reference to FIGS. 19 and 20.

Figure 19:
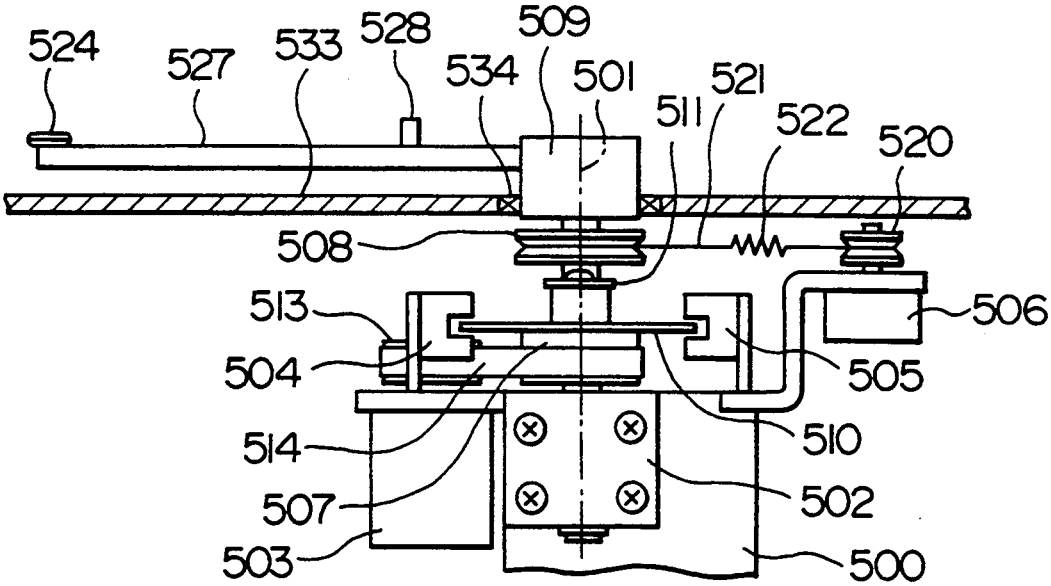
FIG. 19 is a sectional view of the unprocessed lens configuration measuring section.
Figure 20:
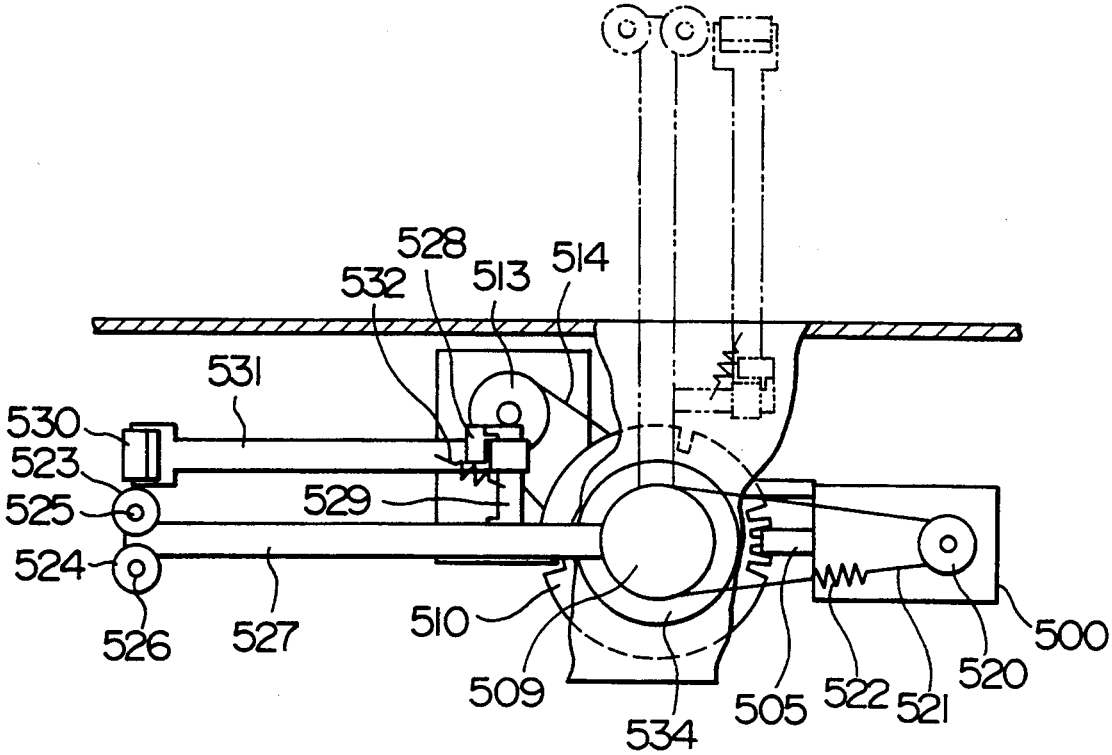
FIG. 20 is a plan view of the unprocessed lens configuration measuring section.

FIG. 19 is a sectional view of the unprocessed lens configuration measuring section 5 and FIG. 20 is a plan view of the same.

A shaft 501 is rotatably mounted on a frame 500 through the intermediation of a bearing 502. Further mounted on the frame 500 are a DC motor 503, photoswitches 504 and 505, and a potentiometer 506.

A pulley 507 is rotatably mounted on the shaft 501. Further mounted on the shaft 501 are a pulley 508 and a flange 509.

Mounted on the pulley 507 are a sensor plate 510 and a spring 511.

Figure 21:
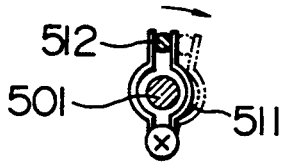
FIG. 21 is a diagram illustrating the operation of a spring and a pin.

As shown in FIG. 21, the spring 511 is attached to the pulley 508 such that it holds a pin 512. As a result, when the spring 511 rotates with the pulley 507, the spring 511 exerts a resilient force on the pin 512 to be rotated, which is attached to the rotatable pulley 508. If the pin 512 moves in, for example, the direction indicated by the arrow independently of the spring 511, the above-mentioned resilient force acts such as to restore the pin 512 to the original position.

Attached to the rotating shaft of the motor 503 is a pulley 513, and the rotation of the motor 503 is transmitted to the pulley 507 through a belt 514 stretched between the pulleys 513 and 507.

The rotation of the motor 503 is detected and controlled by the photoswitches 504 and 505 through the sensor plate 510 attached to the pulley 507.

Rotation of the pulley 507 causes the pulley 508, to which the pin 512 is attached, to rotate, with the rotation of the pulley 508 being detected by the potentiometer 506 through a rope 521 stretched between the pulley 508 and a pulley 520, which is attached to the rotating shaft of the potentiometer 506. In this process, the shaft 501 and the flange 509 rotate simultaneously with the rotation of the pulley 508. A spring 522 serves to keep the tension of the rope 521 constant.

Feelers 523 and 524 are rotatably mounted on a measurement arm 527 by means of pins 525 and 526, the measurement arm 527 being attached to the flange 509.

Figure 22:
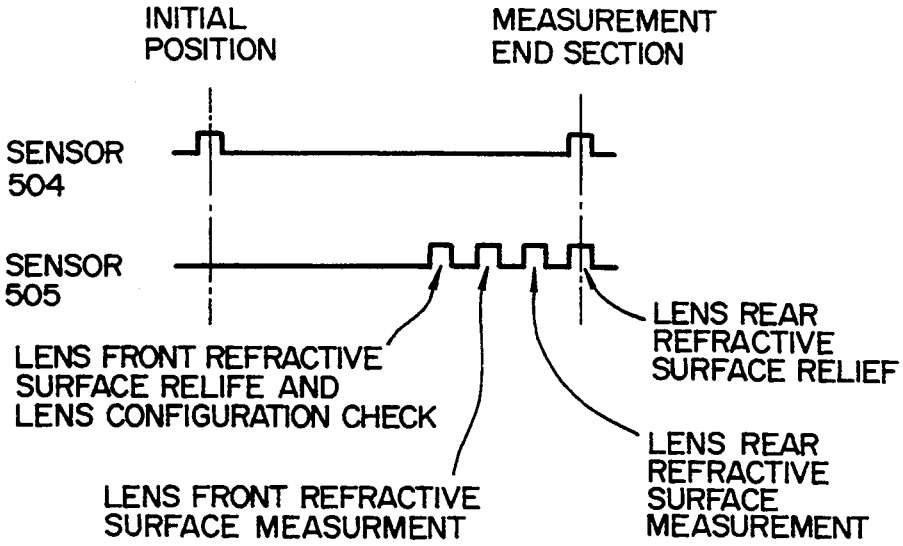
FIG. 22 is a chart illustrating the relationship between the signals of photoswitches 504 and 505.

The photoswitch 504 detects the initial position and the measurement end position of the measurement arm 527. The photoswitch 505 detects the relief position and the measurement position of the feelers 523 and 524 with respect to the front refractive surface and the rear refractive surface of the lens. The measurement end position detected by the photoswitch 504 coincides with the relief position with respect to the rear refractive surface of the lens detected by the photoswitch 505. FIG. 22 is a chart showing the mutual relationship between the signals of the photoswitches 504 and 505.

Figure 23:
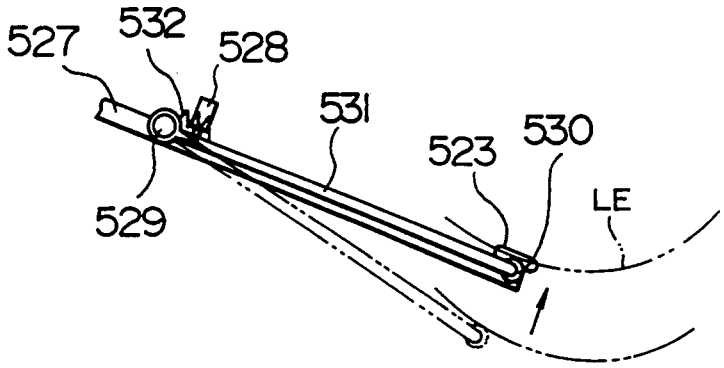
FIG. 23 is a diagram illustrating a lens radius vector measuring operation.

As shown in FIG. 23, the measurement arm 527 is equipped with a shaft 529, to which a microswitch 528 is attached. Provided on the shaft 529 is a rotatable arm 531 having a rotatable feeler 530. This rotatable arm 531 is retained in the direction of the arrow by a spring 532, with the position of the feeler 530 being detected by the microswitch 528.

A cover 533 serves to prevent adhesion of grinding water, etc. to the measurement device, and a seal member 534 serves to prevent grinding water etc., from entering the measurement device through the gap between the device and the cover.

While in this embodiment a third feeler 530 is provided such as to abut against the lens edge, it is possible to omit this feeler 530 since the feelers 523 and 524 also indicate abnormal data when the lens is not fit for the processing.

(b) Measuring Method

Figure 24:
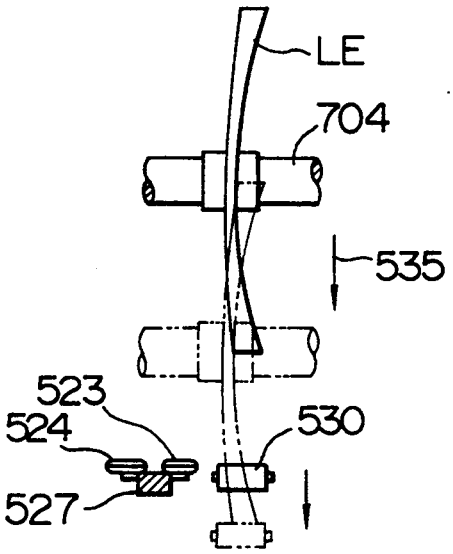
FIGS. 24, 25 and 26 are diagrams illustrating the measuring operation performed in the measuring section.

First, the motor 503, which is controlled by the photoswitch 505, is rotated so as to rotate the measurement arm 527 from the initial position to the relief position with respect to the front refractive surface of the lens, as shown in FIG. 24. In the relief position, the feeler 523 and the lens are positioned as not to interfere with each other when the carriage 700 holding the lens is displaced in the direction indicated by the arrow and, at the same time, the feeler 530 is positioned so as to abut against the lens edge.

Subsequently, the lens LE is displaced in the direction of the arrow 535. The displacement amount is controlled on the basis of the data on the configuration of the eyeglass frame portion into which the processed lens is to be fitted. On the basis of this data, the lens moves in the direction indicated by the arrow.

Figure 25:
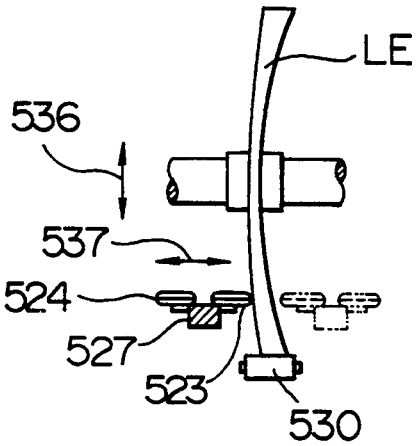
Figure 26:
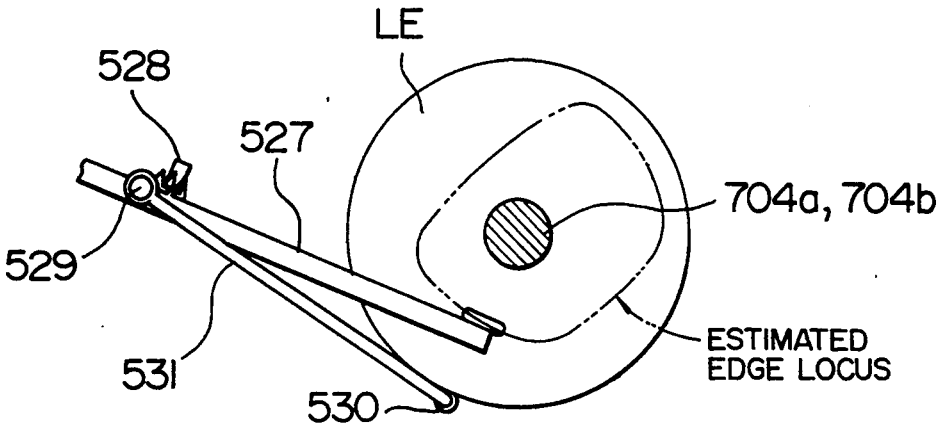

If there is no deviation of the lens size from the configuration data, the feeler 530 abuts against the lens edge and moves in the direction of the arrow 535, with this action being detected by the microswitch 528. If the lens size deviates from the configuration data, a display is given on the display section 3, through a signal of the microswitch 528, to the effect that grinding cannot be performed. When the microswitch 528 detects the movement of the feeler 530, the motor 503 is rotated in such a manner as to cause the feeler 523 to abut against the front refractive surface of the lens in order to measure the configuration of the front refractive surface of the lens. The rotation is effected to a position which is determined taking into account the general thickness of the lens and the length in the lens edge direction of the feeler 530. This condition is shown in FIGS. 25 and 26.

When the feeler 523 moves to the position indicated by the two-dot chain line, the force of the spring 511 attached to the pulley 507 acts in such a manner as to cause the feeler 523 to abut against the front refractive surface.

One rotation of the lens around chuck shafts **704*a* and 704*b* causes the lens to move in the direction of the arrow 536 and the feeler 523 to move in the direction of the arrow 537 in accordance with the above configuration data on the eyeglass frame portion, the movement amount being detected by the potentiometer 506 through the rotation amount of the pulley 508, whereby the configuration of the front refractive surface of the lens is obtained. At the same time, the microswitch 528** also performs measurement to determine whether or not it is possible to process the lens into the eyeglass configuration in conformity with the above data, and the result of the measurement is displayed.

Afterwards, the carriage 700 is returned to the initial position and the motor 503 is further rotated to bring the lens to the relief position with respect to the rear refractive surface. The lens is then moved to the measurement position, the movement amount being measured by the feeler 524 in the same manner as in the measurement of the front refractive surface while causing the lens to make one rotation.

(5) Processing of Measurement Information

Next, processing of data obtained by the lens frame portion and template configuration measurement section and the unprocessed lens configuration measurement section will be described.

Measurement data of the lens frame portion and template configuration measurement section (rn, $\theta$n, zn) (n=1, 2, . . . , N) is subjected to polar-orthogonal coordinate transformation, and, from arbitrary four points (x1, y1, z1), (x2, y2, z2), (x3, y3, z3), and (x4, y4, z4) of the data (xn, yn, zn) thus obtained, the frame curve and the frame curve center (xF, yF, zF) are obtained by the tracer arithmetic control circuit 101 (by solving the equation obtained by substituting the coordinate of four points for a general formula of a spherical surface.

Figure 15:
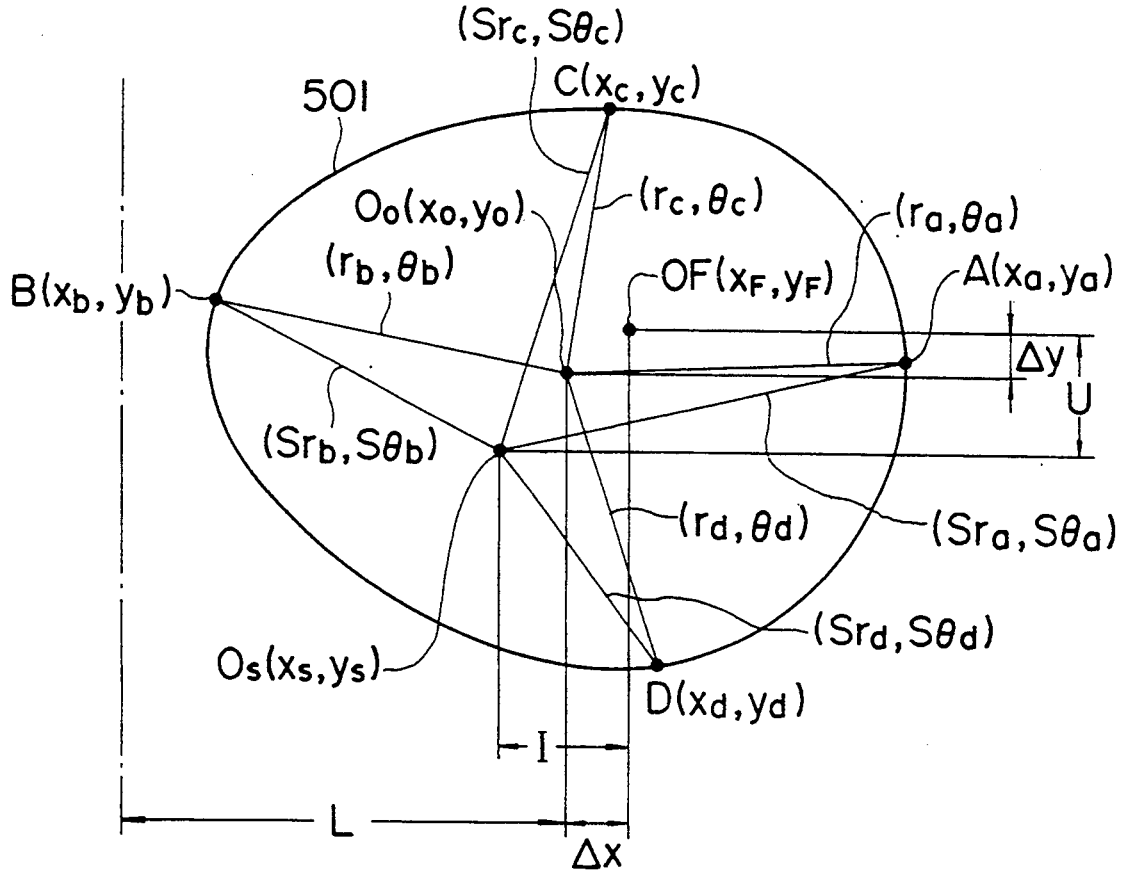
FIG. 15 is a diagram illustrating a coordinate transformation.

Further, referring to FIG. 15, selected from among the x and y components (xn, yn) of (xn, yn, zn) are a measurement point A (xa, ya) having the maximum value in the X-axis direction, a measurement point B (xb, yb) having the minimum value in the X-axis direction, a measurement point C (xc, yc) having the maximum value in the Y-axis direction, and a measurement point D (xd, yd) having the minimum value in the Y-axis direction, and, the geometrical center OF (xF, yF) of the lens frame portion is obtained as:

$$(xF, yF) = \left(\frac{xa + xb}{2}, \frac{yc + yd}{2}\right) \quad (1)$$

From the distance L between the known frame center and the rotational center O0 (x0, y0) of the gauge head section 2120 and the deviation amount (Δx, Δy) between O0 and OF, ½ of the distance FPD between the geometrical centers of the lens frame portions is obtained as:

$$FPD/2 = (L - \Delta x) = \{L - (xF - XO)\} \quad (2)$$

While the method to obtain FPD in the case of the frame holding device by coinciding the frame center with the predetermined point of the device is described above, it is also possible to obtain FPD by using another frame holding device.

The second example for obtaining FPD will now be described.

Figure 16:
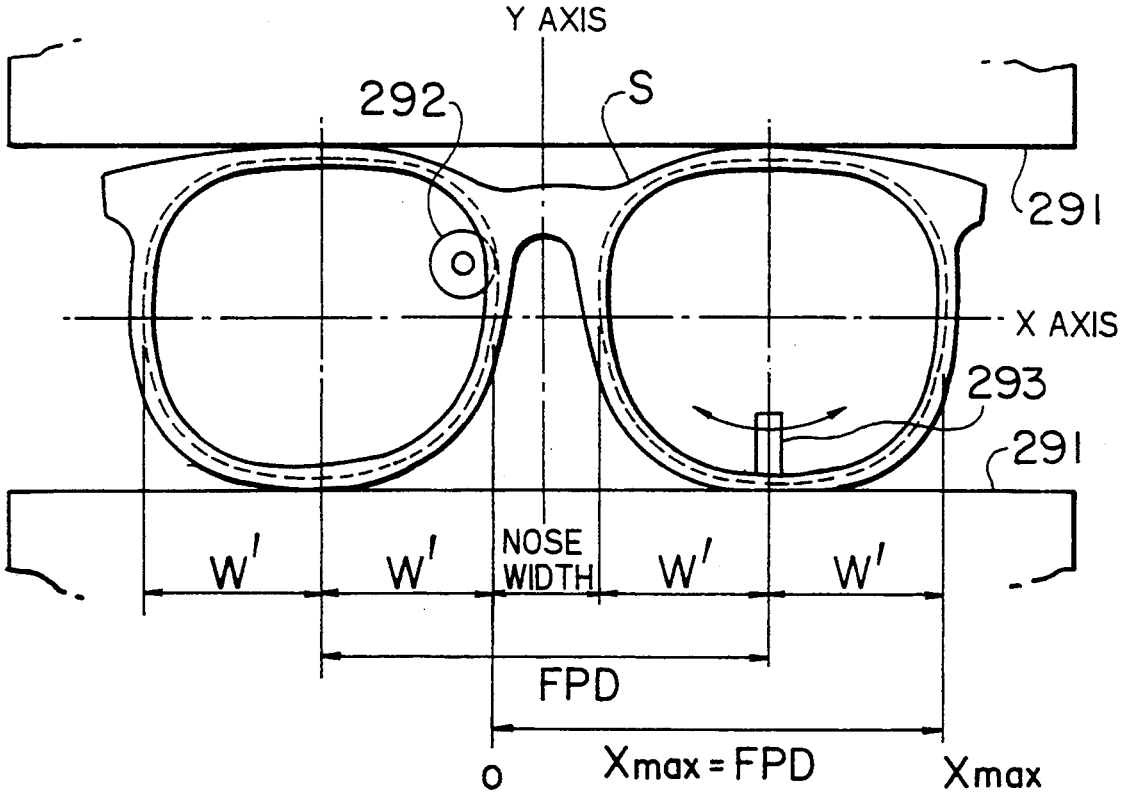
FIG. 16 is a diagram illustrating another method of obtaining the distance between geometrical centers of the eyeglass frame.

In FIG. 16, the reference symbol S indicates eyeglasses, and the reference numeral 291 indicates frame holders adapted to make opposite sliding movements, holding the eyeglasses S therebetween. The reference numerals 292 and 293 respectively indicate a positioning pin and a stylus of the measurement section.

To obtain FPD in a boxing system, that groove bottom section of the lens frame portion not to be traced which is on the side of the nose is abutted against the positioning pin 292, which is capable of moving in the Y-axis direction and the Z-axis direction (i.e., the direction which is perpendicular to the plane of the drawing), biasing the eyeglasses S in such a manner that the positioning pin 292 abuts against that groove bottom section which is nearest to the nose. Then, while holding the frame by means of the frame holders 291 adapted to slide opposite to each other, the lens frame configuration (xn, yn, zn) (n=1, 2, . . . , N) is measured by the above-mentioned measurement section.

The distance between the position 0 of the positioning pin not varying in the X-axis direction and the position where the xn is maximum, can be obtained as FPD.

It is also possible to obtain FPD by abutting the positioning pin 292 against the lens frame portion nearest to the temple and obtaining the minimum value of xn. Further., the positioning pin 292 is not restricted to the type used in this embodiment. Any type of positioning pin that is capable of restriction in the X-axis direction, for example, the stylus of another measurement section, will serve the purpose. Further, instead of biassing the eyeglasses S, the positioning pin 292 may be moved in the X-axis direction.

Further, FPD can also be obtained by tracing the right and left frame portions alternately or simultaneously.

Next, from the pupillary distance PD designated at the input section 4 to be described below, the inner adjustment amount I1 is obtained by the tracer arithmetic control circuit 101 as:

$$I1 = \frac{FPD}{2} - \frac{PD}{2} = \{L - (xF - x0) - PD/2\} \quad (3)$$

Further, on the basis of an inputted upper adjustment amount U1, the position OS (xS, yS), where the optical center of the eyeglass lens to be processed should be located, is obtained as follows:

$$\begin{aligned} Os(xS, yS) &= (xF + I1, yF + U1) \quad (4) \\ &= \left\{\frac{xa + xb}{2} + L - (xF - x0) - \frac{PD}{2}, \frac{xc + yd}{2} + U1\right\} \end{aligned}$$

From this OS, processing data (Srn, SSn) (n=1, 2, . . . , N) is obtained through transformation into polar coordinates having OS as the center. The main arithmetic control circuit 100 receives the processing data.

From an amount of deviation between the front refractive surface and the rear refractive surface, lens edge thickness at each position can be obtained, and, on the basis of the lens edge thickness, the V-groove curve and the V-groove position are determined automatically or by the operator's choice.

Also, the main arithmetic control circuit 100 substitutes detected positions of at least four points on the lens front surface for the general formula of a spherical surface, obtaining a curve of the lens front surface (in the same manner as in calculation of the frame curve).

From the lens edge thickness information measured by means of an unprocessed lens configuration measuring section 5, the V-groove curve and the V-groove position are determined automatically or by the choice in an input section 4 (determination of the V-groove curve and the V-groove position itself being effected in the known method).

In the above adjustment amounts (I1, U1), no consideration is given to the errors due to the curve in the Z-axis direction of the lens frame portion. In view of this, the above adjustment amounts are corrected.

The corrected adjustment amounts are obtained as follows.

Regarding the adjustment amount in the X-axis direction, it will be described with reference to FIG. 17.

From the PD value and the data of the lens curve and the V-groove apex, the corrected adjustment amount is obtained.

Figure 17:
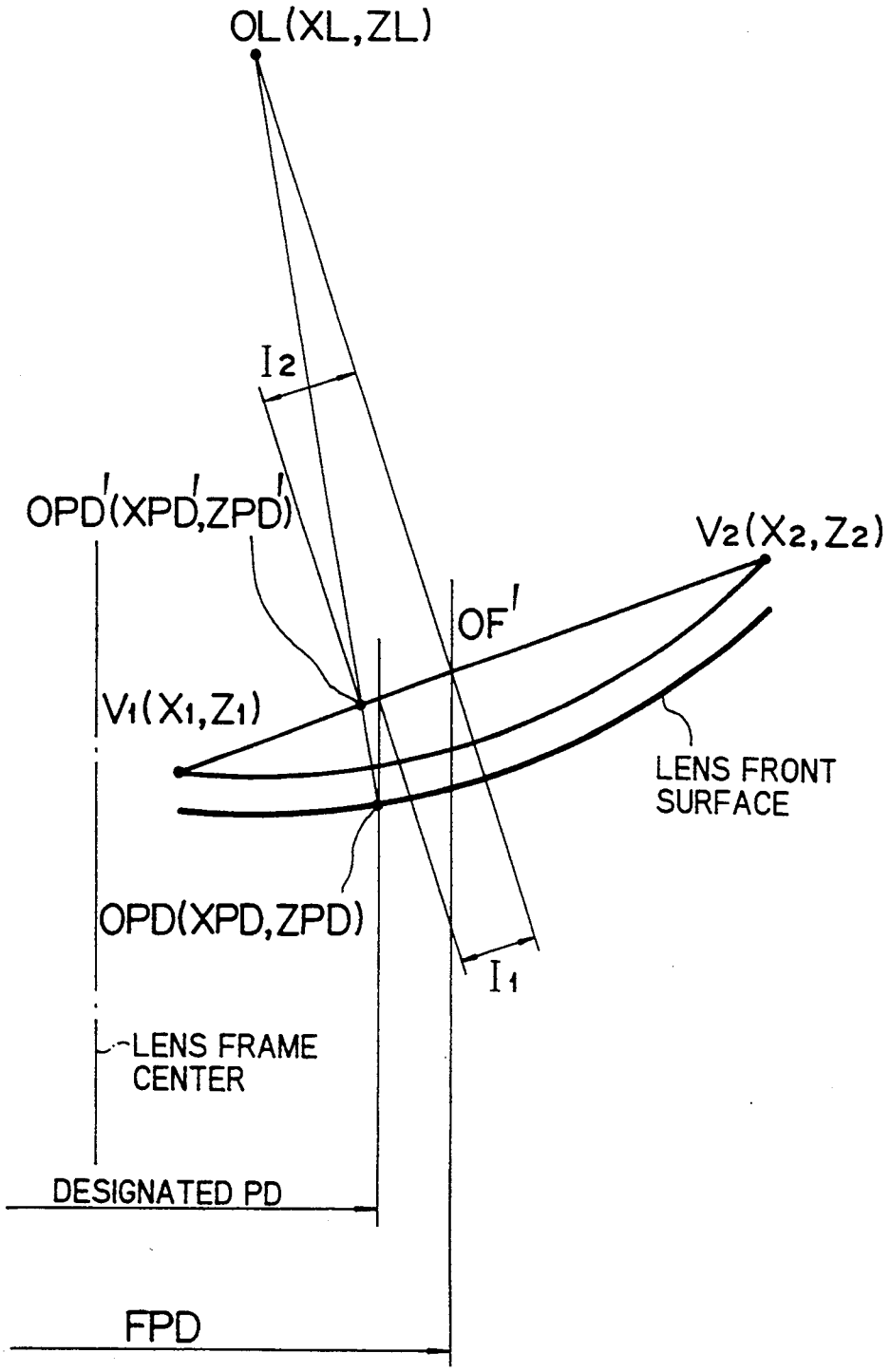
FIG. 17 is a diagram illustrating an adjustment amount computing method.

Suppose, as shown in FIG. 17, the V-groove apex positions on the nose and ear sides are V1 (x1, z1) and V2 (x2, z2) and the middle point therebetween is OF'. Further, suppose the central position of the front curved surface of the lens when fitted into the frame portion is OL (x1, z1) and its radius is rL. It is possible to obtain the central position of the front curved surface of the lens extremely easily if the calculation is performed on the assumption that V1 and V2 are equally spaced away from the front curved surface of the lens. Strictly speaking, the distances from the positions V1 and V2 to the front curved surface of the lens are not equal to each other. However, there is no practical problem in regarding these distances as equal to each other.

From the value in the X-axis direction of the designated PD position, xPD, and the equation expressing the front surface curve, $(x-xL)2+(z-zL)^2=rL^2$, the value in the Z-axis direction of the designated PD position, zPD, is obtained. The point of intersection of the straight line connecting the center OL (xL, zL) of the front surface curve and the PD position on the lens front surface, OPD (xPD, zPD), and the straight line connecting the V-groove apexes V1 (x1, z1) and V2 (x2, z2), is obtained as OPD' (xPD' zPD'), and the distance between the points OF' and OPD' is obtained as the actual adjustment amount in the X-axis direction, I2.

If the V-groove position has not been obtained, it is possible to obtain the adjustment amount with substantially the same level of error as that of the above method provided that the groove apexes of the lens frame portion on the nose and ear sides (which substantially agree with the tracing data on the eyeglasses frame portion) have been obtained. In that case, V1 and V2 substitute for the positions on the nose and ear sides, setting the distances from V1 and V2 to the front curved surface of the lens equal to each other.

The adjustment amount in the Y-axis direction, U2, is obtained in the like manner, and, on the basis of I2 and U2, the position where the optical center of the lens to be processed should be located, OS' (xS', yS'), is obtained From this OS' processing data (Srn', Sθn') (n=1, 2, . . . , N) is obtained through transformation of (xn, yn) into polar coordinates having OS' as the center, obtaining the V-groove curve and the V-groove position again.

While in this embodiment, the adjustment amount correction is effected by measuring the arrangement and configuration of the lens, this method of correction should not be construed as restrictive. The correction could be effected in a simple manner as follows: for example, since the FPD value and the curve in the Z-axis direction augment in proportion to the frame size, the mutual relationship between the FPD value and the adjustment amount can be approximately obtained, correcting the adjustment in a simple manner on the basis of this mutual relationship. This mutual relationship is stored in a memory in the form of a table. Such a simple method of correction is substantially the same as the correction method described above and is covered by the conception of the present invention.

In the device of this embodiment, the configuration measurement can be performed on each of the right and left lens frame portions, or, alternatively, it may be performed on only one of them, applying inverted data to the remaining frame portion.

With the apparatus for and the method of obtaining processing information for fitting lenses in an eyeglasses frame and the eyeglasses grinding machine of the present invention, the adjustment amount can be previously calculated so that no deviation may be involved between the designated PD value and the distance between the optical centers of the processed lenses, irrespective of the configuration of the frame, lenses, etc.

What is claimed is:

1. An apparatus for obtaining processing information for fitting lenses in an eyeglass frame, comprising:

(a) a measurement means for measuring the three-dimensional configuration of the eyeglass frame, said measurement means including a holder means for holding the eyeglass frame, a gauge head to be closely fitted in a groove portion of the eyeglass frame, and a detection means for detecting a radius vector direction of the gauge head and displacements thereof in the radius vector direction and the vertical direction;

(b) a first calculation means for calculating a distance between the geometrical centers of left and right lens frame portions of the eyeglass frame from the results of detection by said detection means;

(c) an input means for inputting information in relation to an adjustment amount, which includes a pupillary distance measured by a device;

(d) a second calculation means for calculating an apparent adjustment amount of the optical centers of the lenses to be processed from the distance between the geometrical centers obtained by said first calculation means and the information inputted by said input means;

(e) a third calculation means including contact elements to abut against the front and rear surfaces of the lenses to be processed so as to obtain the lens curve from movement amounts of the contact elements at at least four points on the lenses to be processed;

(f) a correction means for correcting errors of said apparent adjustment amount, which are caused by fitting conditions of the lenses to be processed, on the basis of the following data:

(i) displacement data measured by said measurement means;

(ii) position data of the lens front surface under an apparent fitting condition of the lenses to be processed with respect to the eyeglass frame, the position data being determined based on said displacement data and the apparent adjustment amount calculated by said second calculation means;

(iii) the lens curve obtained by said third calculation means, and (iv) the pupillary distance inputted by said input means; and (g) a conversion means for converting the results of detection by said detection means into a predetermined form of processing information on the basis of the corrected adjustment amount obtained by said correction means.

2. An apparatus for obtaining processing information for fitting lenses in an eyeglass frame, comprising:

(a) a measurement means for measuring the three-dimensional configuration of the eyeglass frame, said measurement means including a holder means for holding the eyeglass frame, a gauge head to be closely fitted in a groove portion of the eyeglass frame, and a detection means for detecting a radius vector direction of the gauge head and displacements thereof in the radius vector direction and the vertical direction;

(b) a first calculation means for calculating a distance between the geometrical centers of left and right lens frame portions of the eyeglass frame from the results of detection by said detection means;

(c) an input means for inputting information in relation to an adjustment amount, which includes a pupillary distance measured by a device;

(d) a second calculation means for calculating an apparent adjustment amount of the optical centers of the lenses to be processed from the distance between the geometrical centers obtained by said first calculation means and the information inputted by said input means;

(e) a third calculation means including contact elements to abut against the front and rear surfaces of the lenses to be processed so as to obtain the lens curve from movement amounts of the contact elements at at least four points on the lenses to be processed;

(f) a correction means for correcting errors of said apparent adjustment amount, which are caused by fitting conditions of the lenses to be processed, on the basis of the following data:

(i) groove bottom positions on the nose and ear sides of the lens frame portions which are obtained by said detection means;

(ii) the lens curve obtained by said third calculation means; and (iii) the pupillary distance inputted by said input means; and (g) a conversion means for converting the results of detection by said detection means into a predetermined form of processing information on the basis of the corrected adjustment amount obtained by said correction means.

3. An apparatus for obtaining processing information for fitting lenses in an eyeglass frame, comprising:

(a) a measurement means for measuring the two-dimensional configuration of the eyeglass frame, said measurement means including a holder means for holding the eyeglass frame, a gauge head to be closely fitted in a groove portion of the eyeglass frame, and a detection means for detecting a displacement of the gauge head in the radius vector direction;

(b) a first calculation means for calculating a distance between the geometrical centers of left and right lens frame portions of the eyeglass frame from the results of detection by said detection means;

(c) an input means for inputting information in relation to an adjustment amount, which includes a pupillary distance measured by a device;

(d) a second calculation means for calculating an apparent adjustment amount of the optical centers of the lenses to be processed from the distance between the geometrical centers obtained by said first calculation means and the information inputted by said input means;

(e) a memory means for storing, in the form of a table, the relationship between the distance between the geometrical centers of the left and right lens frame portions, and errors of said apparent adjustment amount which are caused by fitting conditions of the lenses to be processed;

(f) a correction means for correcting the errors of said apparent adjustment amount on the basis of the table stored in said memory means and the distance between the geometrical centers of the left and right lens frame portions obtained by said first calculation means; and (g) a conversion means for converting the results of detection by said detection means into a predetermined form of processing information on the basis of the corrected adjustment amount obtained by said correction means.

4. A method of obtaining processing information for fitting lenses in an eyeglass frame, comprising the steps of:

(a) measuring the three-dimensional configuration of the eyeglass frame by a measurement means including a gauge head to be closely fitted in a groove portion of eyeglass frame in a condition of holding the eyeglass frame;

(b) calculating a distance between geometrical centers of left and right lens frame portions of the eyeglass frame from data in the radius vector direction of the eyeglass frame;

(c) measuring a pupillary distance of an eyeglasses user;

(d) calculating an apparent adjustment amount of the optical centers of the lenses to be processed from the calculated distance between the geometrical centers and the pupillary distance;

(e) obtaining the lens curve from movement amounts of contact elements abutting against the front and rear surfaces of the lenses to be processed;

(f) correcting errors of said apparent adjustment amount, which are caused by fitting conditions of the lenses to be processed on the basis of the following data:

(i) displacement data from said step of measuring the three-dimensional configuration of the eyeglass frame;

(ii) position data of the lens front surface under an apparent fitting condition of the lenses to be processed with respect to the eyeglass frame, the position data being determined based on said displacement data and the apparent adjustment amount from said step of calculating the apparent adjustment amount of the optical centers of the lenses;

(iii) the lens curve from step of obtaining the lens curve, and (iv) the pupillary distance from said step of measuring the pupillary distance; and (g) converting the measured data of said eyeglass frame into a predetermined form of processing information on the basis of the corrected adjustment amount.

5. A method of obtaining processing information for fitting lenses in an eyeglass frame, comprising the steps of:

(a) measuring the three-dimensional configuration of the eyeglass frame by a measurement means including a gauge head to be closely fitted in a groove portion of eyeglass frame in a condition of holding the eyeglass frame;

(b) calculating a distance between geometrical centers of left and right lens frame portion of the eyeglass frame from data in the radius vector direction of the eyeglass frame;

(c) measuring a pupillary distance of an eyeglasses user;

(d) calculating an apparent adjustment amount of the optical centers of the lenses to be processed from the calculated distance between the geometrical centers and the pupillary distance;

(e) obtaining the lens curve from movement amounts of contact elements abutting against the front and rear surfaces of the lenses to be processed;

(f) correcting errors of said apparent adjustment amount, which are caused by fitting conditions of the lenses to be processed on the basis of the data of detected groove bottom positions on the nose and ear sides of the lens frame portions, said lens curve and said pupillary distance; and, (g) converting the measured data of said eyeglass frame into a predetermined form of processing information on the basis of the corrected adjustment amount.

6. A method of obtaining processing information for fitting lenses in an eyeglass frame, comprising the steps of:

(a) measuring the two-dimensional configuration of the eyeglass frame by a measurement means including a gauge head to be closely fitted in a groove portion of eyeglass frame in a condition of holding the eyeglass frame;

(b) calculating a distance between geometrical centers of left and right lens frame portion of the eyeglass frame from data in the radius vector direction of the eyeglass frame;

(c) measuring a pupillary distance of an eyeglasses user;

(d) calculating an apparent adjustment amount of the optical centers of the lenses to be processed from the calculated distance between the geometrical centers and the pupillary distance;

(e) storing, in the form of a table, the relationship between the distance between the geometrical centers of the left and right lens frame portions, and errors of said apparent adjustment amount which are caused by fitting conditions of the lenses to be processed;

(f) correcting the errors of said apparent adjustment amount on the basis of the stored table and the distance between the calculated geometrical centers of the left and right lens frame portions; and (g) converting the measured data of said eyeglass frame into a predetermined form of processing information on the basis of the corrected adjustment amount.

7. An eyeglass grinding machine for fitting lenses in an eyeglass frame, provided with an apparatus for obtaining processing information for fitting lenses in the eyeglass frame, comprising:

(a) a measurement means for measuring the three-dimensional configuration of the eyeglass frame, said measurement means including a holder means for holding the eyeglass frame, a gauge head to be closely fitted in a groove portion of the eyeglass frame, and a detection means for detecting a radius vector direction of the gauge head and displacements thereof in the radius vector direction and the vertical direction;

(b) a first calculating means for calculating a distance between the geometrical centers of the left and right lens frame portions of the eyeglass frame from the results of detection by said detection means;

(c) an input means for inputting information in relation to an adjustment amount, which includes a pupillary distance measured by a device;

(d) a second calculation means for calculating an apparent adjustment amount of the optical centers of the lenses to be processed from the distance between the geometrical centers obtained by said first calculation means and the information inputted by said input means;

(e) a third calculation means including contact elements to abut against the front and rear surfaces of the lenses to be processed so as to obtain the lens curve from movement amounts of the contact elements at at least four points on the lenses to be processed;

(f) a correction means for correcting errors of said apparent adjustment amount, which are caused by fitting conditions of the lenses to be processed, on the basis of the following data:

(i) displacement data measured by said measurement means;

(ii) position data of the lens front surface under an apparent fitting condition of the lenses to be processed with respect to the eyeglass frame, the position data being determined based on said displacement data and the apparent adjustment amount calculated by said second calculation means;

(iii) the lens curve obtained by said third calculation means, and (iv) the pupillary distance inputted by said input means; and (g) a conversion means for converting the results of detection by said detection means into a predetermined form of processing information on the basis of the corrected adjustment amount obtained by said correction means.

8. An eyeglass grinding machine for fitting lenses in an eyeglass frame, provided with an apparatus for obtaining processing information for fitting lenses in the eyeglass frame, comprising:

a measurement means for measuring the three-dimensional configuration of the eyeglass frame, said measurement means including a holder means for holding the eyeglass frame, a gauge head to be closely fitted in a groove portion of the eyeglass frame, and a detection means for detecting a radius vector direction of the gauge head and displacements thereof in the radius vector direction and the vertical direction;

(b) a first calculation means for calculating a distance between the geometrical centers of left and right lens frame portions of the eyeglass frame from the results of detection by said detection means;

(c) an input means for inputting information in relation to an adjustment amount, which includes a pupillary distance measured by a device;

(d) a second calculation means for calculating an apparent adjustment amount of the optical centers of the lenses to be processed from the distance between the geometrical centers obtained by said first calculation means and the information inputted by said input means;

(e) a third calculation means including contact elements to abut against the front and rear surfaces of the lenses to be processed so as to obtain the lens curve from movement amounts of the contact elements at at least four points on the lenses to be processed;

(f) a correction means for correcting errors of said apparent adjustment amount, which are caused by fitting conditions of the lenses to be processed, on the basis of the following data:

(i) groove bottom positions on the nose and ear sides of the lens frame portions which are obtained by said detection means;

(ii) the lens curve obtained by said third calculation means; and (iii) the pupillary distance inputted by said input means; and (g) a conversion means for converting the results of detection by said detection means into a predetermined form of processing information on the basis of the corrected adjustment amount obtained by said correction means.

9. An eyeglass grinding machine for fitting lenses in an eyeglass frame, provided with an apparatus for obtaining processing information for fitting lenses in the eyeglass frame, comprising:

(a) a measurement means for measuring the two-dimensional configuration of the eyeglass frame, said measurement means including a holder means for holding the eyeglass frame, a gauge head to be closely fitted in a groove portion of the eyeglass frame, and a detection means for detecting a displacement of the gauge head in the radius vector direction;

(b) a first calculation means for calculating a distance between the geometrical centers of left and right lens frame portions of the eyeglass frame from the results of detection by said detection means;

(c) an input means for inputting information in relation to an adjustment amount, which includes a pupillary distance measured by a device;

(d) a second calculation means for calculating an apparent adjustment amount of the optical centers of the lenses to be processed from the distance between the geometrical centers obtained by said first calculation means and the information inputted by said input means;

(e) a memory means for storing, in the form of a table, the relationship between the distance between the geometrical centers of the left and right lens frame portions, and errors of said apparent adjustment amount which are caused by fitting conditions of the lenses to be processed;

(f) a correction means for correcting the errors of said apparent adjustment amount on the basis of the table stored in said memory means and the distance between the geometrical centers of the left and right lens frame portions obtained by said first calculation means; and (g) a conversion means for converting the results of detection by said detection means into a predetermined form of processing information on the basis of the corrected adjustment amount obtained by said correction means.

* * * * *